US010894652B2

(12) United States Patent
Bates et al.

(10) Patent No.: US 10,894,652 B2
(45) Date of Patent: Jan. 19, 2021

(54) INFLATABLE CUSHIONING WEB

(71) Applicant: Sealed Air Corporation (US), Charlotte, NC (US)

(72) Inventors: Andrew Bates, Bedford, MA (US); Laurence Sperry, Newton, MA (US); Amy Curneen, Brookline, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/468,720

(22) PCT Filed: Dec. 15, 2017

(86) PCT No.: PCT/US2017/066569
§ 371 (c)(1),
(2) Date: Jun. 12, 2019

(87) PCT Pub. No.: WO2018/112287
PCT Pub. Date: Jun. 21, 2018

(65) Prior Publication Data

US 2019/0308791 A1 Oct. 10, 2019

Related U.S. Application Data

(60) Provisional application No. 62/435,307, filed on Dec. 16, 2016, provisional application No. 62/434,781, filed on Dec. 15, 2016.

(51) Int. Cl.

| | |
|---|---|
| ***B65D 81/05*** | (2006.01) |
| ***B65D 30/24*** | (2006.01) |
| ***B31D 5/00*** | (2017.01) |

(52) U.S. Cl.
CPC ..... *B65D 81/052* (2013.01); *B31D 5/0073* (2013.01); *B65D 31/14* (2013.01)

(58) Field of Classification Search
CPC ..... B65D 31/14; B65D 81/052
USPC ..... 206/522, 459.5, 521.7, 589; 428/156; 53/568
See application file for complete search history.

(56) References Cited

U.S. PATENT DOCUMENTS

| | | | |
|---|---|---|---|
| 6,318,013 | B1 | 11/2001 | Cope |
| 6,550,229 | B2 | 4/2003 | Sperry et al. |
| 6,629,777 | B2 | 10/2003 | Tanaka et al. |

(Continued)

FOREIGN PATENT DOCUMENTS

| | | | |
|---|---|---|---|
| DE | 1952469 | A1 | 4/1971 |
| EP | 1163990 | A2 | 12/2001 |

(Continued)

*Primary Examiner* — Anthony D Stashick
*Assistant Examiner* — Raven Collins
(74) *Attorney, Agent, or Firm* — Jon M. Isaacson

(57) ABSTRACT

An inflatable web (10) includes a top film (30) heat sealed to a bottom film (32) to define sealed regions (40) and non-sealed regions (214). The non-sealed regions include inflatable regions (216) that are inflatable through one or more inflation ports. The top film (30) may have a color that differs from the color of the bottom film (32) to create a visual contrast between the sealed regions (40) and the adjacent non-sealed regions (214) when the web is viewed from the top film side. The ratio of the surface area of the inflatable regions (216) to the total surface area of the inflatable web is at least 50% and at most 95%.

7 Claims, 14 Drawing Sheets

(56) References Cited

U.S. PATENT DOCUMENTS

| | | | | |
|---|---|---|---|---|
| 6,651,406 | B2 | 11/2003 | Sperry et al. | |
| 6,800,162 | B2 | 10/2004 | Kannankeril et al. | |
| 6,972,151 | B2 | 12/2005 | Bronson | |
| 7,165,375 | B2 | 1/2007 | O'Dowd | |
| 7,220,476 | B2 * | 5/2007 | Sperry | B31D 5/0073 206/522 |
| 7,429,304 | B2 | 9/2008 | McNamara et al. | |
| 7,507,311 | B2 | 3/2009 | O'Dowd | |
| 8,562,216 | B2 | 10/2013 | Kendall et al. | |
| 8,695,311 | B2 | 4/2014 | Daigle et al. | |
| D720,617 | S * | 1/2015 | Wehrmann | D9/456 |
| 8,991,141 | B2 | 3/2015 | Sperry et al. | |
| 2005/0263426 | A1 * | 12/2005 | Ho | B65D 81/02 206/522 |
| 2006/0108052 | A1 | 5/2006 | Kannankeril et al. | |
| 2009/0017261 | A1 * | 1/2009 | Hurley, Jr. | B31D 5/0073 428/166 |
| 2011/0048634 | A1 * | 3/2011 | Kim | B29C 66/439 156/285 |
| 2011/0106035 | A1 * | 5/2011 | Arora | A61L 15/56 604/367 |
| 2014/0262913 | A1 * | 9/2014 | Schweighardt | B63C 11/02 206/522 |
| 2015/0075114 | A1 | 3/2015 | Murch et al. | |
| 2016/0129626 | A1 * | 5/2016 | Arora | A61F 13/5126 264/40.1 |
| 2019/0009476 | A1 | 1/2019 | Sperry et al. | |

FOREIGN PATENT DOCUMENTS

| | | | |
|---|---|---|---|
| EP | 1698566 | A1 | 9/2006 |
| EP | 2554489 | A1 | 2/2013 |
| FR | 2044567 | * | 2/1971 |
| FR | 2044567 | A5 | 2/1971 |
| GB | 1302940 | A | 1/1973 |
| KR | 20110006202 | U | 6/2011 |
| WO | 02100737 | A1 | 12/2002 |
| WO | 03051740 | A2 | 6/2003 |
| WO | 16174111 | A1 | 11/2016 |

* cited by examiner

INFLATABLE CUSHIONING WEB

BACKGROUND

The presently disclosed subject matter relates to an inflatable web, useful once inflated, for example, as protective packaging cushioning.

SUMMARY

One or more embodiments of the presently disclosed subject matter are summarized herein.

An inflatable web has a longitudinal direction and a transverse direction perpendicular to the longitudinal direction and includes a top film heat sealed to a bottom film to define sealed regions and non-sealed regions. The sealed regions have the top film heat sealed to the bottom film. The non-sealed regions having the top film not heat sealed to the bottom film. The non-sealed regions further include inflatable regions that are inflatable through one or more inflation ports. The top film either (i) is colorless by not including colorant or (ii) includes a top film mixture of thermoplastic polymer and one or more top film colorants dispersed therein to provide a top film color. The bottom film includes a bottom film mixture of thermoplastic polymer and one or more bottom film colorants dispersed therein to provide a bottom film color. The bottom film color differs from the top film color or top film lack of color to create a visual contrast between the sealed regions and the adjacent non-sealed regions when the web is viewed from the top film side. The ratio of the surface area of the inflatable regions to the total surface area of the inflatable web is at least 50% and at most 95%.

These and other objects, advantages, and features of the presently disclosed subject matter will be more readily understood and appreciated by reference to the detailed description and the drawings.

Figure 1:
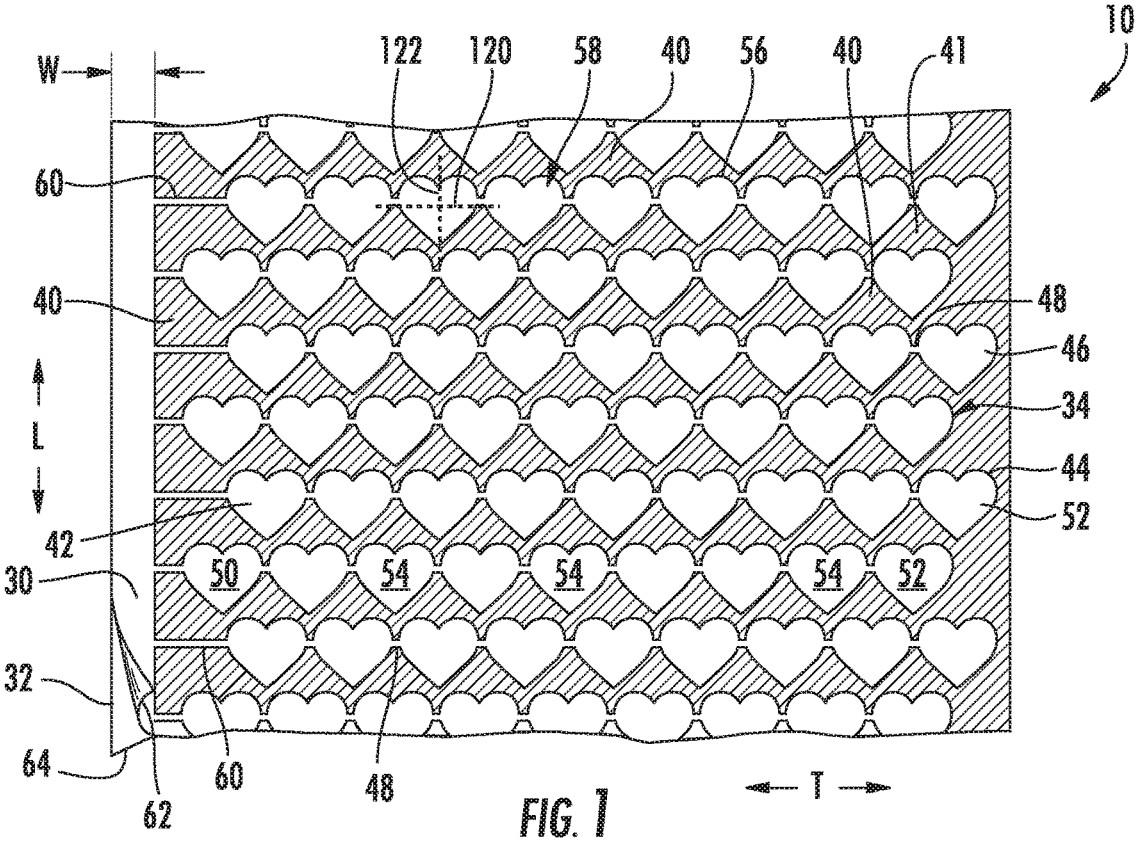
FIG. 1 is a representative top plan view of an inflatable web 10.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

Inflatable webs (e.g., 10, 12, 18, 22, 210, 268, 280) of the presently disclosed subject matter include a top film 30 sealed to a bottom film 32 in selected regions 40 to define a plurality of inflation rows (e.g., 34, 36, 38). (FIGS. 1, 1A, 7, and 9.)

Top and Bottom Films

Suitable top and bottom films (e.g., 30, 32, 266, 264, the white film, green film, red film) include films having at least one surface conducive to sealing to another film in selected regions. For example, either of the top and bottom films (e.g., 30, 32) may be a monolayer film comprising a heat sealable (e.g., thermoplastic) polymer, or may be a multilayer film comprising an inside layer comprising a heat sealable polymer. A film inherently has two external surfaces, described herein as an "inside" surface and an "outside" surface opposite the inside surface. The "inside" layer of a multilayer film is the layer forming the inside surface of the film, and the "outside" layer of a multilayer film is the layer forming the outside surface of the film. As used herein, the top and bottom films sealed to each other have their "inside" surfaces (i.e., their inside layers if multilayered) facing each other, with their "outside" surfaces opposing the inside surfaces.

The top and bottom films 30, 32 may be initially distinct, separate films that are superimposed and sealed, or the top and bottom films 30, 32 may be created from a single expanse of film by folding the single expanse of film over onto itself to create a folded edge (e.g., a "C" fold).

The films of any of the embodiments herein may comprise any flexible material that can be manipulated to enclose a gas in the inflatable cells created between the films. Useful materials may include one or more thermoplastic polymers, such as polymers selected from one or more of polyethylene homopolymer, polyethylene copolymer, polypropylene homopolymer, polypropylene copolymer (e.g., propylene/ethylene copolymer), polyester, polystyrene, polyamide, and polycarbonate. Polyethyene homopolymer may be selected from, for example, one or more of low density polyethylene (LDPE) and high density polyethylene (HDPE). Polyethylene copolymer may be selected from, for example, one or more of ionomers, ethylene/vinyl acetate copolymer, ethylene/methyl(meth)acrylate copolymer, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from C3 to C20 alpha-olefins, such as 1-butene, 1-pentene, 1-hexene, 1-octene, methyl pentene and the like, in which the polymer molecules comprise long chains with relatively few side chain branches, and include, for example, linear low density polyethylene (LLDPE), linear medium density polyethylene (LMDPE), very low density polyethylene (VLDPE), and ultra-low density polyethylene (ULDPE).

The top and bottom films (e.g., 30, 32) may independently be monolayer or multilayer. The top and bottom films may be made by film forming processes known in the art, such as extrusion or coextrusion by melting the component polymer (s) and extruding or coextruding them through one or more flat or annular dies.

Inflatable Web

Inflatable web 10 has top film 30 sealed to bottom film 32 in selected sealed regions 40 to define a plurality of inflation rows 34 between the films. The inflatable web has a longitudinal (i.e., machine) direction "W" and a transverse direction "T" extending perpendicularly to the longitudinal direction. (FIG. 1.)

Each inflation row 34 has a proximal end 42 and a distal end 44 opposite the proximal end. Each inflation row comprises a plurality of inflatable cells 46. The inflatable cells 46 of an inflation row 34 are in fluid communication with each other via interconnecting inflation channels 48 between adjacent inflatable cells 46. Each plurality of inflatable cells 46 of an inflation row 34 includes a proximal inflatable cell 50 at the proximal end 42 of the inflation row, a distal inflatable cell 52 at the distal end 44 of the inflation row 34, and a plurality of intermediate inflatable cells 54 between the proximal inflatable cell 50 and the distal inflatable cell 52. (FIG. 1.)

Figure 7:
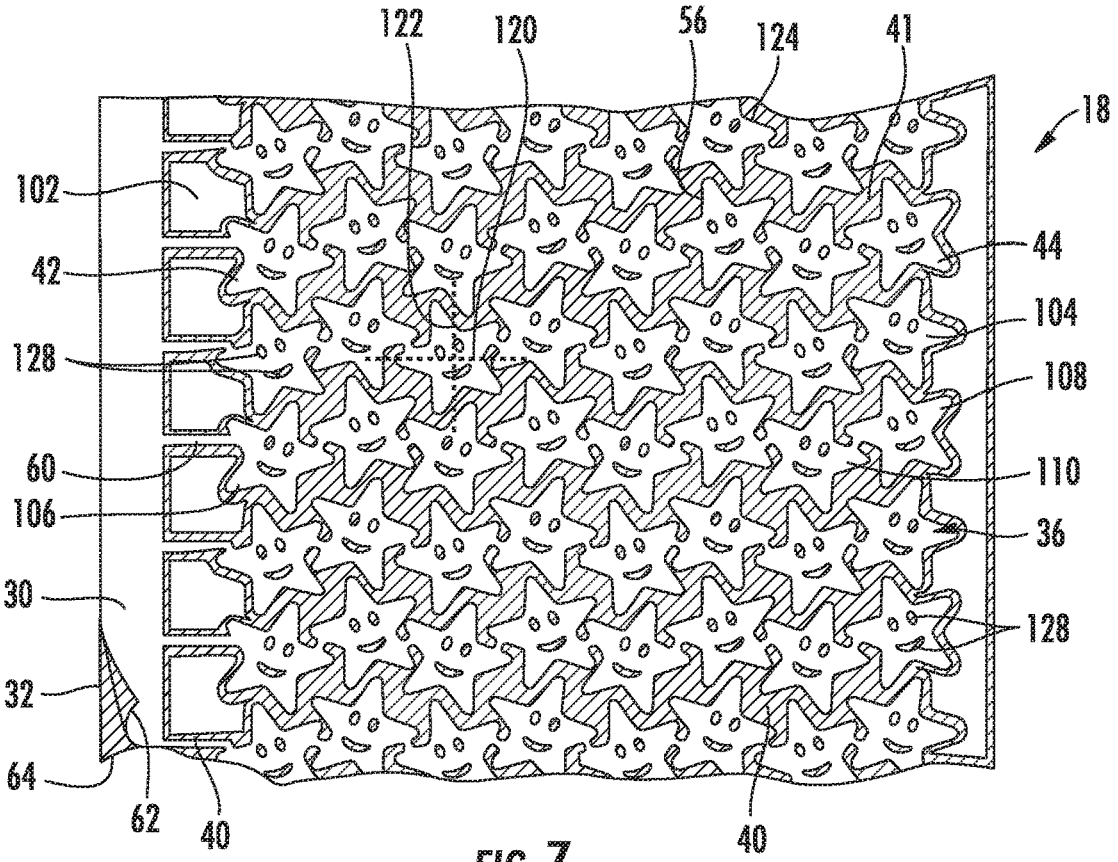
FIG. 7 is a representative top plan view of an alternative inflatable web 18.
Figure 9:
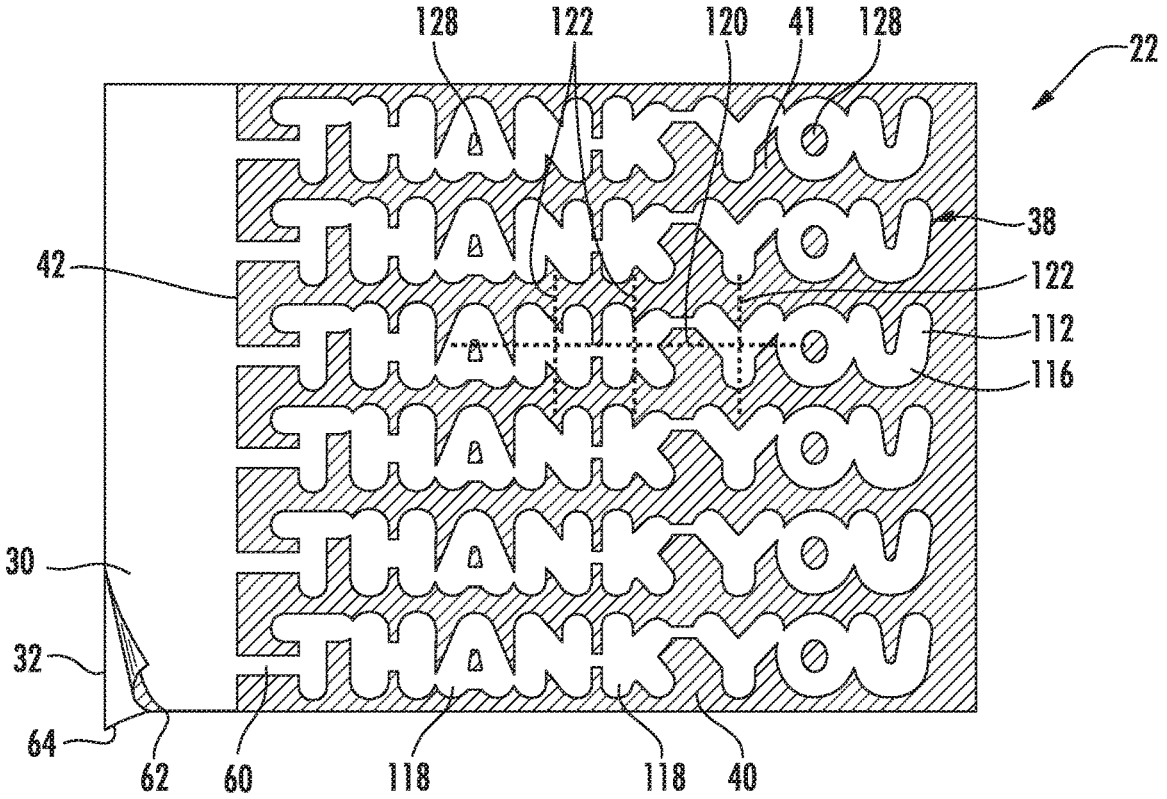
FIG. 9 is a representative top plan view of an alternative inflatable web 22.

The sealed regions 40 of the top and bottom films 30, 32 define each inflatable cell 46 by a peripheral seal boundary 56 defining the corresponding peripheral shape 58 of the inflatable cell. For example, in FIG. 1 the plurality of inflatable cells 46, such as the plurality of intermediate inflatable cells 54, have a peripheral shape of a heart. In FIG. 7, the plurality of inflatable cells 104, such as the plurality of intermediate inflatable cells 110 between proximal inflatable cell 106 and distal inflatable cell 108, have a peripheral shape of a star. As illustrated, the star is 5-pointed; however, the star shape may be selected from any of, for example, a 4, 5, 6, 7, and 8 sided star. In FIG. 9, the plurality of inflatable cells 112, such as the plurality of intermediate inflatable cells 118 between proximal inflatable cell 114 and distal inflatable cell 116, have a peripheral shape of a letter, for example, a letter of the English language.

Figure 1A:
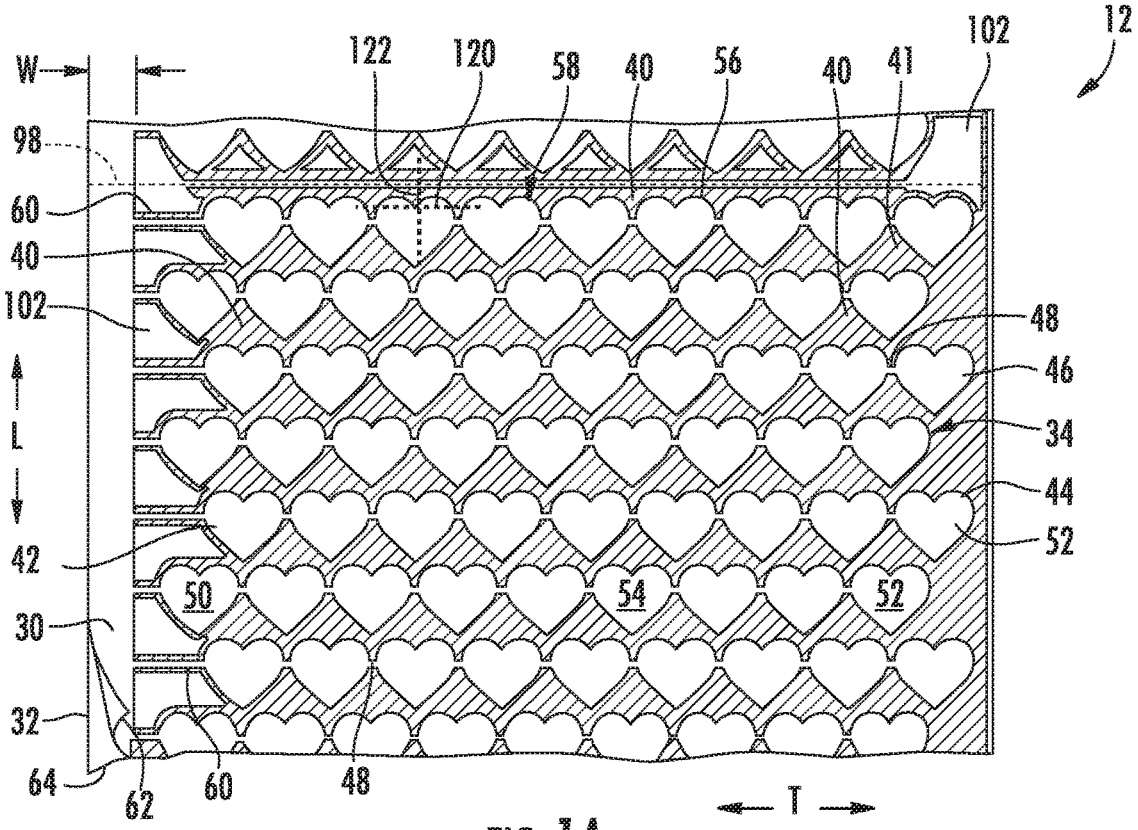
FIG. 1A is a representative top plan view of an alternative inflatable web 12.

The plurality of inflatable cells of a respective inflation row may have the same peripheral shape. For example, the plurality of intermediate inflatable cells of a respective inflation row may have the same peripheral shape. (FIGS. 1, 1A, and 7.)

Alternatively, at least any of 2, 3, 5, and/or 8 inflatable cells of the plurality of inflatable cells of a respective inflation row may have differing peripheral shapes. For example, at least any of 2, 3, 5, and/or 8 inflatable cells of the plurality of intermediate inflatable cells of a respective inflation row may have differing peripheral shapes (FIG. 9.)

Also by way of example, at least any of 2, 3, 5, and/or 8 of the plurality of inflation cells of the respective inflation row, for example of the plurality of intermediate inflatable cells of the respective inflation row, of at least any of 2, 3, 5, and/or 8 inflation rows of the plurality of inflation rows may have differing peripheral shapes within the respective inflation row. (FIG. 9.)

The peripheral shape of the plurality of inflatable cells of an inflation row, for example the plurality of intermediate inflatable cells of an inflation row, of at least one of the plurality of inflation rows may differ from the peripheral shape of the plurality of inflatable cells of another inflation row, for example the plurality of intermediate inflatable cells of another inflation row, of the plurality of inflation rows. For example, the peripheral shape of the plurality of inflatable cells, for example the plurality of intermediate inflatable cells, of a first inflation row of the plurality of inflation rows may differ from the peripheral shape of the plurality of inflatable cells, for example the plurality of intermediate inflatable cells, of a second inflation row of the plurality of inflation rows that is adjacent the first inflation row.

In some embodiments, the plurality of intermediate inflatable cells of two adjacent inflation rows have corresponding peripheral seal boundaries that are spaced apart. "Spaced apart" in this sense means that, for the intermediate inflatable cells of a given first inflation row and the intermediate inflatable cells of a given second inflation row adjacent the given first inflation row, there is a spaced region (e.g., spaced region 41 of FIGS. 1, 1A, 7, 9) between the peripheral seal boundaries of the adjacent portions of the inflatable cell of the first inflation row and the inflatable cell of the second inflation row, such that the spaced region does not function (i.e., contribute significantly) to the retention of inflation gas (e.g., air) within the inflated inflatable cell by the peripheral seal boundaries. The spaced regions may comprise (a) unsealed areas between the top and bottom films, (b) sealed areas between the top and bottom films, and (c) both (a) and (b).

The spacing apart of the corresponding seal boundaries of the plurality of intermediate inflatable cells of two adjacent inflation rows may help to distinguish the peripheral shapes to provide greater visual impact for the peripheral shape of the inflatable cells 46.

In some embodiments the plurality of intermediate inflatable cells of two adjacent inflation rows have corresponding peripheral seal boundaries that correlate with each other. "Correlate" in this sense means that, for the intermediate inflatable cells of a given first inflation row and the intermediate inflatable cells of a given second inflation row adjacent the given first inflation row, the paths of the peripheral seal boundaries of the directly adjacent portions of the inflatable cell of the first inflation row and the inflatable cell of the second inflation row follow each other to coincide.

Correlating corresponding peripheral seal boundaries of the intermediate inflatable cells of adjacent inflation rows may be spaced apart, as described herein, or alternatively may be shared, wherein there is no spaced region between the corresponding peripheral seal boundaries.

The selected sealed region 40 may be discontinuous, as shown by inflatable web 12 (FIG. 1A), to delineate one or more unsealed areas 102 that are not configured for inflation.

The peripheral seal boundary 56 of each of the inflatable cells 46 accommodates the interconnecting inflation channels 48; for example, the proximate inflatable cell 50 and the distal inflatable cell 52 are each in fluid communication with a corresponding adjacent intermediate inflatable cell of the plurality of intermediate inflatable cells 54 via a corresponding interconnecting inflation channel 48; and each of the intermediate inflatable cells 54 accommodates two of the interconnecting inflation channels 48, for example to connect two adjacent inflatable cells in fluid communication for inflation, but without significantly interrupting the peripheral seal boundary 56 so that the desired peripheral shape remains largely intact, for example without significantly diminished visual impression or recognition of the peripheral shape.

The selected seal regions 40 sealing the top and bottom films 30, 32 also define the inflation ports 60 at the proximal end 42 of each of the inflation rows. The inflation port 60 provides a pathway for an inflation gas (e.g., air) to be injected between the top and bottom films 30, 32 into an inflation row (34, 36, 38) to inflate the inflatable cells (46, 104, 112, respectively) of the inflation row. (FIGS. 1, 7, 9.)

The inflatable web may comprise top and bottom flanges 62, 64, which are formed by a portion of top film 30 and bottom film 32, respectively, extending beyond the inflation ports 60 and the proximal edge of sealed region 40. For example, flanges 62, 64 of FIG. 1 extend beyond inflation ports 60 and sealed region 40 for a given width (shown as width "W"). For example, flanges 62, 64 may each independently be at least inch or at least % inch in width. The flanges may have different widths, or the top and bottom flanges 62, 64 may have equivalent widths as shown in FIG. 1. Flanges 62, 64, in conjunction with inflation ports 60 and the proximal edge of sealed region 40, constitute an open inflation zone of the inflatable web 10 for use in conjunction with an inflation machine to inflate the inflation rows 34. As discussed herein, the inner surfaces of flanges 62, 64 may be brought into close slidable contact with outwardly facing surfaces of an appropriately configured inflation nozzle or other inflation device to provide a partially closed inflation zone which promotes efficient and reliable sequential inflation of the inflation rows 34 without restricting the movement of the web or inflation nozzle that is required to effect a sequential inflation.

Referring to FIG. 1, the peripheral shape 58 of the inflatable cells 46, for example, the plurality of intermediate inflatable cells 54 of a respective inflation row 34 of the plurality of inflation rows may be asymmetrical relative to at least one of (a) a line 120 extending in the transverse direction through the middle of the inflatable cell and (b) a line 122 extending in the longitudinal direction through the middle of the inflatable cell, and optionally both of (a) and (b). For example, the peripheral shape 58 of a heart for the plurality of inflatable cells 46 of FIG. 1 is asymmetrical relative the transverse line 120 and symmetrical relative the longitudinal line 122. Referring to FIG. 7, the peripheral shape 124 of a star for the plurality of inflatable cells 104 of FIG. 7 is symmetrical relative to the transverse line 120 and asymmetrical relative the longitudinal line 122. Referring to FIG. 9, the peripheral shape 126 of a letter for the plurality of inflatable cells 104 of FIG. 9 is asymmetrical or symmetrical depending on the specific letter shape and its orientation relative to both the transverse line 120 and the longitudinal line 122. For example, the inflatable cell 112 having the peripheral shape of letter "N" is asymmetrical relative to both the transverse line 120 and the longitudinal line 122. The inflatable cell 112 having the peripheral shape of letter "K" is symmetrical relative to the transverse line 120 and asymmetrical relative the longitudinal line 122. The inflatable cell 112 having the peripheral shape of letter "Y" is asymmetrical relative to the transverse line 120 and symmetrical relative the longitudinal line 122.

The inflatable cell 104 may comprise one or more internal sealed regions 128 within (i.e., circumscribed by) the peripheral seal boundary 56 of the sealed region 40. (FIG. 7.) Accordingly, one or more of the plurality of inflatable cells 104 of the respective inflation row 36, for example one or more of the plurality of intermediate inflatable cells 110 of the respective inflation row 36, may comprise one or more internal sealed regions 128 within (i.e., circumscribed by) the respective peripheral seal boundary 56 of the inflatable cell. (FIG. 7.) For example, at least any of 2, 3, 5, and/or 8 of the plurality of inflation cells 104 of a respective inflation row 36, for example of the plurality of intermediate inflatable cells 110 of a respective inflation row 36, may comprise one or more internal sealed regions 128 within (i.e., circumscribed by) the peripheral seal boundary 56 of the inflatable cell.

Also by way of example, at least any of 2, 3, 5, and/or 8 inflation rows of the plurality of inflation rows 36 of the web, may comprise one or more of the plurality of inflatable cells 104 of the respective inflation row 36, for example one or more of the plurality of intermediate inflatable cells 110 of the respective inflation row 36, having one or more internal sealed regions 128 within (i.e., circumscribed by) the respective peripheral seal boundary 56 of the inflatable cell.

Of the inflatable cells having one or more internal sealed regions 128 within the peripheral seal boundary 56, the inflatable cell may further comprises any of two or more and three or more internal sealed regions 128 within (i.e., circumscribed by) the peripheral seal boundary 56. (FIG. 7.)

FIG. 9 illustrates inflatable cell 112 having a peripheral seal boundary 56 in the shape of the letter "A" or the letter "O" having an internal sealed region 128 within (i.e., circumscribed by) the peripheral seal boundary 56 of the sealed region 40.

The internal sealed regions 128 within the peripheral seal boundary 56 of an inflatable cell may be created as the same time and as part of the formation of the selected sealed regions 40, as described herein.

The configurations of inflatable cells that have internal sealed regions 128 within the peripheral seal boundary 56 of the inflatable cell have particular usefulness in imparting structure that even upon inflation of the inflatable cell provides recognizable features such as those of a facial expression or other pictograph (e.g., smiley face or other emoji) and certain letters (e.g., "A", "B", "D", "O", "P", "Q", "R").

Inflatable web 10 may include one or more lines of weakness 98 that allow sections of predetermined length to be separated from the inflated web. Transverse lines of weakness 98 may comprise, for example, a series of perforations, and extend from the distal edge to the proximal edge, to and through flanges 62, 64 of web 10.

Manufacture of Inflatable Web

The top and bottom films disclosed herein (e.g., 30, 32) (i.e., the inside surface of these films) may be sealed together in the selected regions 40 by heat seals or by adhesive seals. For example, top and bottom films 30, 32 may comprise a thermoplastic heat sealable polymer on their inside surface such that, after superposition of films 30, 32, the inflatable web 10 can be formed by passing the superposed top and bottom films between the nip of two cylinders (i.e., rollers), for example, at least one of the rollers ("sealing roller") having a surface of heated raised land areas that correspond in shape to the desired pattern for the selected region 40, 212. The sealing roller applies heat to seal the top and bottom films together to form seals in the selected regions 40, 212, and thereby also creates the inflation rows 34 comprising the inflation ports 60, the inflatable cells 46, and the interconnecting inflation channels 48 in unsealed areas between the top and bottom films. The non-sealing surface areas of the sealing cylinder may be unheated, depressed surface portions—and may be insulated to reduce heat transfer to the films.

Suitable ways of sealing the top and bottom films together in the selected regions 40, 212 are further disclosed in U.S. Pat. Nos. 6,800,162 and 7,507,311 and U.S. Pat. App. Publ. 2006/0108052 A1, each of which is incorporated herein in its entirety by reference.

As discussed herein, the top and bottom films 30, 32 may be initially distinct, separate films that are superimposed and sealed, or the top and bottom films 30, 32 may be created from a single expanse of film by folding the single expanse of film over onto itself to create a folded edge (e.g., a "C" fold) and having the sealing surface of the film creating the inside surfaces of the structure. In such case, the longitudinal distal edge opposite from flanges 62, 64 is closed. (FIG. 1.)

Inflation of the Inflatable Web

FIGS. 2 to 5 illustrate a representative apparatus or machine 16 for inflating web 10. Apparatus 16 includes a conveying mechanism, generally indicated at 66, an inflation nozzle 68, and a sealing device 70. Conveying mechanism 66 conveys web 10 along a path of travel as shown, which allows inflation nozzle 68 to sequentially inflate each of the inflation rows 34 (and the inflatable cells therein) and sealing device 70 to seal closed the inflation rows. The "path of travel" (or "travel path") of web 10 refers to the route that such web traverses while being conveyed through apparatus 16 in this manner, as indicated by the shape assumed by the web as it is manipulated by the conveying mechanism.

Figure 4:
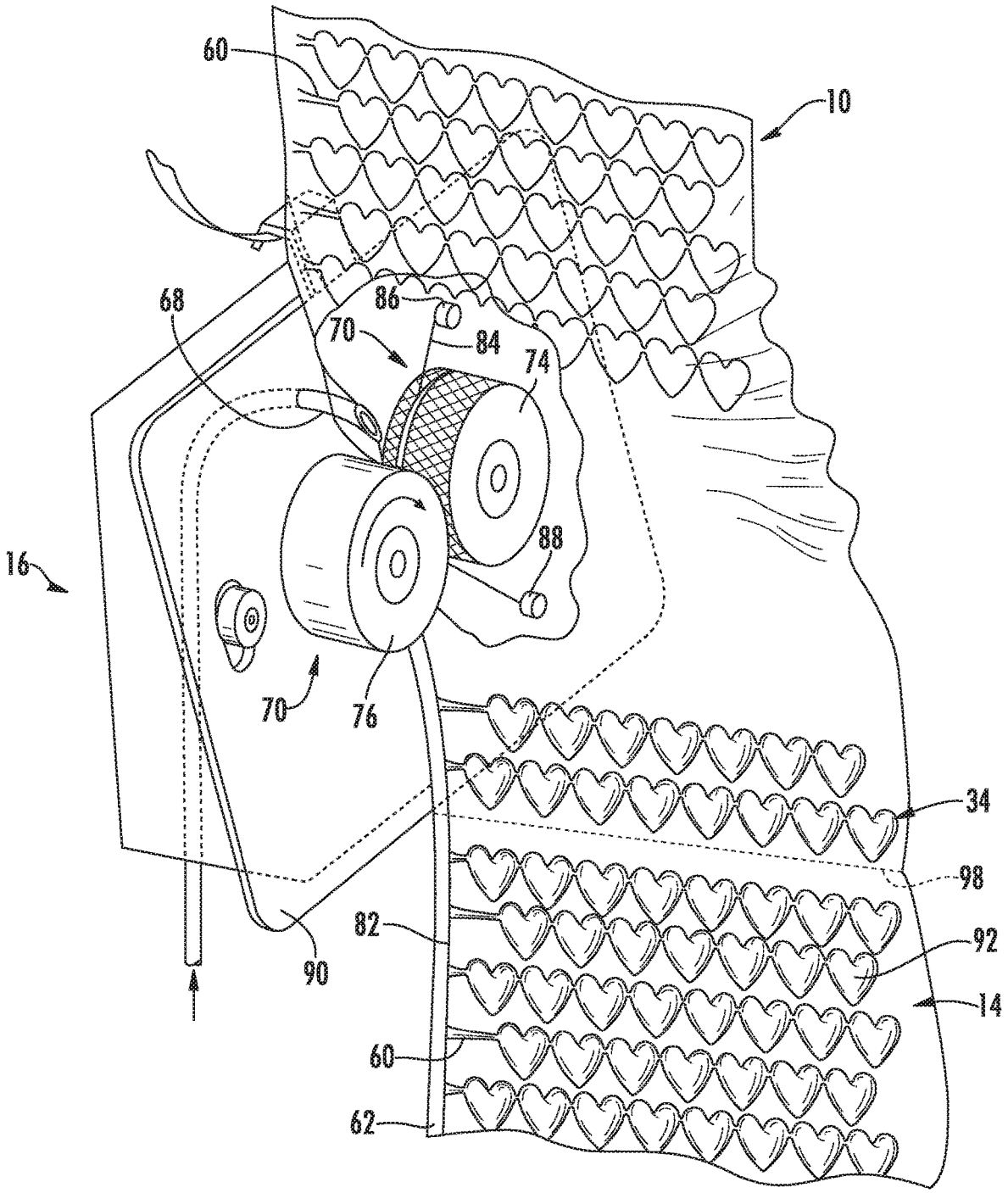
FIG. 4 is a representative perspective view of a portion of apparatus 16 of FIG. 3.

Conveying mechanism 66 may include a shaft 72 mounted to housing 73, a pair of adjacent, counter-rotatable cylinders 74 and 76, and a guide roll 81. Web 10 may be in the form of supply roll 78, which may be wound on spool 80 and mounted on shaft 72. Web 10 is advanced (i.e., unwound) from supply roll 78, with guide roll 81 directing the web between cylinders 74, 76 in a substantially vertical direction as shown. Cylinders 74, 76 are capable of engaging and moving web 10 along its travel path through apparatus 16 when a portion of the film web passes between the cylinders and the cylinders rotate in the directions indicated in FIG. 3 against the web. The counter-rotation of the cylinders against web 10 exerts sufficient force on web 10 to cause rotation of supply roll 78, thus dispensing web 10 for travel through apparatus 16 as shown. At least one of cylinders 74, 76 may have an uneven surface (e.g., a knurled or abraded surface as shown in FIG. 4, or a grooved or inwardly threaded surface). The opposing cylinder (i.e., opposite the cylinder having an uneven surface) may have a surface formed of a relatively resilient or pliable material, such as silicone or rubber, which may have grooves in the surface thereof. One or both cylinders 74, 76 may be coupled to a motive source (e.g., an electrical, hydraulic, or pneumatic motor) (not shown) having a rotational output to cause the cylinders to rotate.

Sealing device 70 is preferably positioned immediately downstream from inflation nozzle 78, so that each inflation row 34 may be sealed closed immediately after being inflated and/or contemporaneous with inflation. The sealing device 70 preferably seals closed the corresponding inflation port 60 of inflation row 34 by forming a continuous longitudinal seal 82.

A representative sealing device is illustrated in FIG. 4, where a portion of web 10 has been broken away for clarity, and includes an electrically conductive heating element 84 having a first end secured to a first node 86 and a second end secured to a second node 88. Heating element 84 is positioned between cylinders 74, 76 such that cylinder 74 rotates against the heating element, which is stationary and fixed to platform 90 via nodes 86 and 88. Cylinder 74 preferably includes a circumferential groove in which heating element 84 rides as cylinder 74 rotates against the heating element 84. Cylinder 76 also rotates against the heating element, but at the nip (point of tangential contact) between the cylinders.

Figure 2:
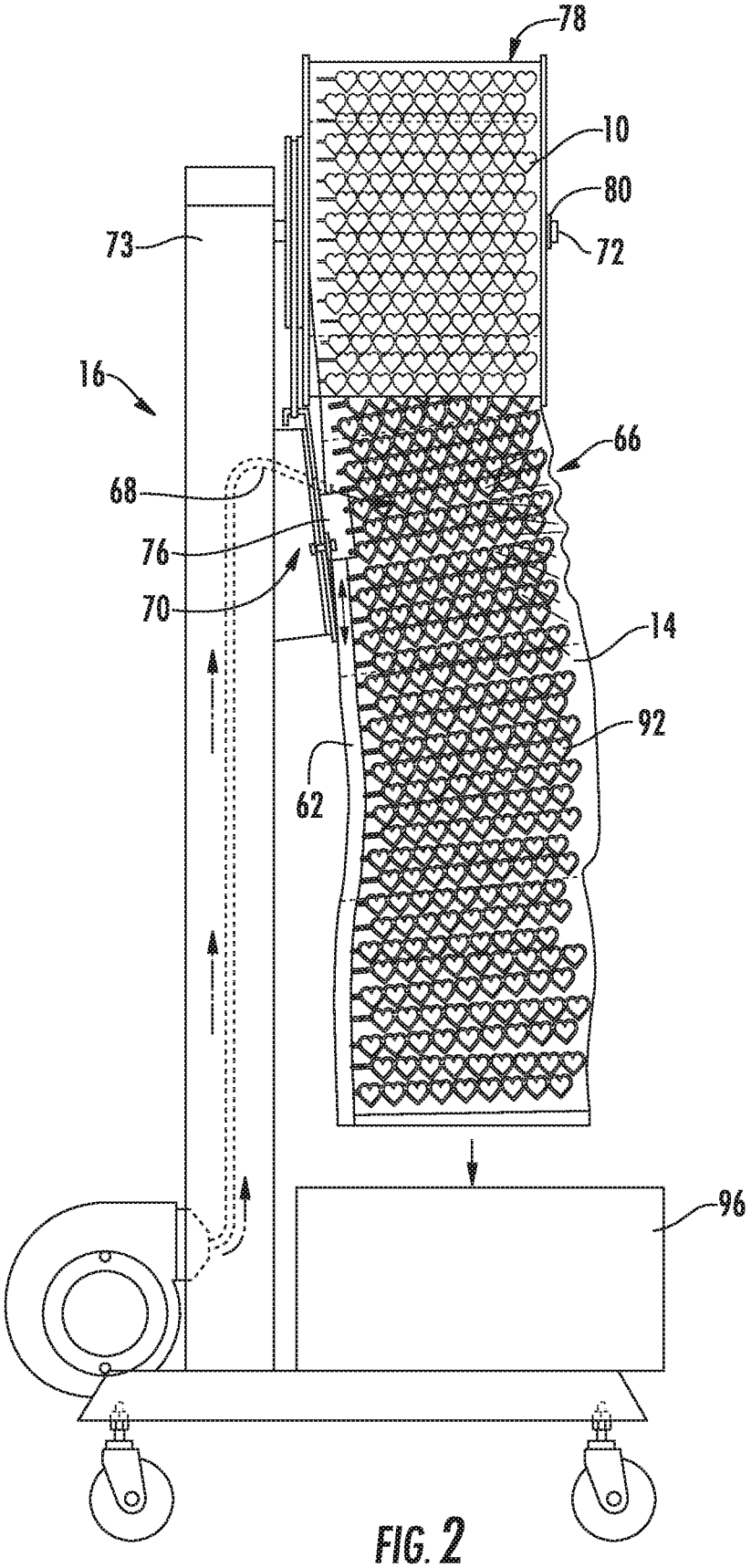
FIG. 2 is a representative side elevational view of an apparatus 16 for inflating the inflatable web 10.
Figure 3:
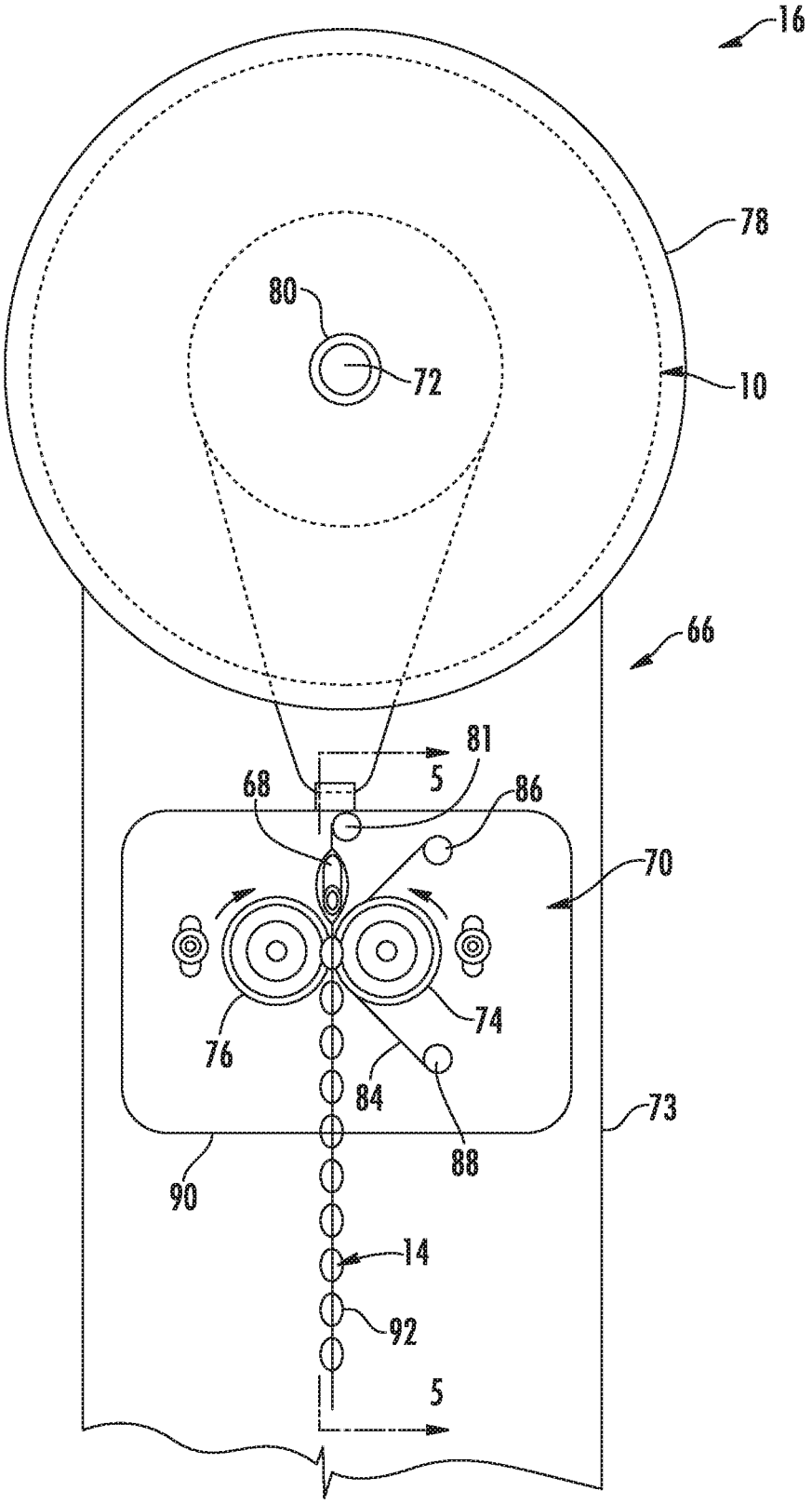
FIG. 3 is a representative partial front elevational view of the apparatus 16 of FIG. 2.

The inflation port 60 of each inflation row 34 is sealed closed when conveying mechanism 66 brings web 10 into moving contact with heating element 84 between cylinders 74, 76 and sufficient current is caused to flow through the heating element 84 to heat it to a sealing temperature sufficient to form longitudinal heat seal 82 between juxtaposed top and bottom films 30, 32 of web 10. The sealing of each inflation port 16 occurs shortly after inflation of the corresponding inflation row 34. In this manner, gas from inflation nozzle 78 is trapped (i.e., enclosed) within each inflatable cell 46, resulting in the formation of an inflated web 14 comprising inflated cells 92. The inflated web 14 may be collected in basket or container 96. (FIG. 2.)

The sealing temperature to form longitudinal seal 82 between top and bottom films 30, 32 of web 10 comprising thermoplastic polymer is that which causes the films 30, 32 to weld or fuse together by becoming temporarily fully or partially molten in the area of contact with the heating element 84. Such temperature (i.e., the sealing temperature) may readily be determined by those of ordinary skill in the art without undue experimentation for a given application based on, for example, the composition and thickness of the films to be sealed, the speed at which the films move against the heating element, and the pressure at which the films and heating element are urged together between cylinders 74, 76. As an example, when films 30, 32 comprise polyethylene-based films ranging in thickness from 0.001 to 0.003 inch (for a combined, juxtaposed thickness ranging from 0.002 to 0.006 inch), the sealing temperature to which heating element 84 is heated may range from 300 to 500° F.

Heating element 84 may be any device capable of heating to a predetermined temperature sufficient to heat-seal films 30, 32 together. Suitable types of devices for heating element 84 include one or more wires comprising metal and/or other electrically conductive materials; one or more ribbons comprising metal; circuit-printed plastic ribbons (e.g., metal printed on a plastic substrate comprising polyethylene terephthalate); and other suitable electrically conductive devices. Further, the sealing wire may be fully or partially wrapped about the outer circumference of a cylinder, as described in one or more of the references incorporated herein.

Useful sealing machines and related devices that may be used herein are disclosed, for example, in U.S. Pat. Nos.

7,220,476; 7,429,304; 7,165,375; 8,991,141; 6,550,229; 6,651,406; 8,695,311; U.S. Pat. App. Publ. 2015/0075114 A1; and U.S. Pat. App. Ser. No. 62/288,759, each of which is incorporated herein in its entirety by reference.

As an alternative to employing a heat sealing device, if one or both of films 30, 32 include bonding material (e.g., an adhesive or cohesive material) located within inflation ports 60. Such a bonding material may forms a seal closing the port when films 30, 32 are pressed together between cylinders 74, 76. Additional disclosure for sealing two films together in this manner is described in U.S. Ser. No. 09/591,830 published as counterpart EP 1 163 990 A1, each of which is incorporated herein in its entirety by reference.

Figure 5:
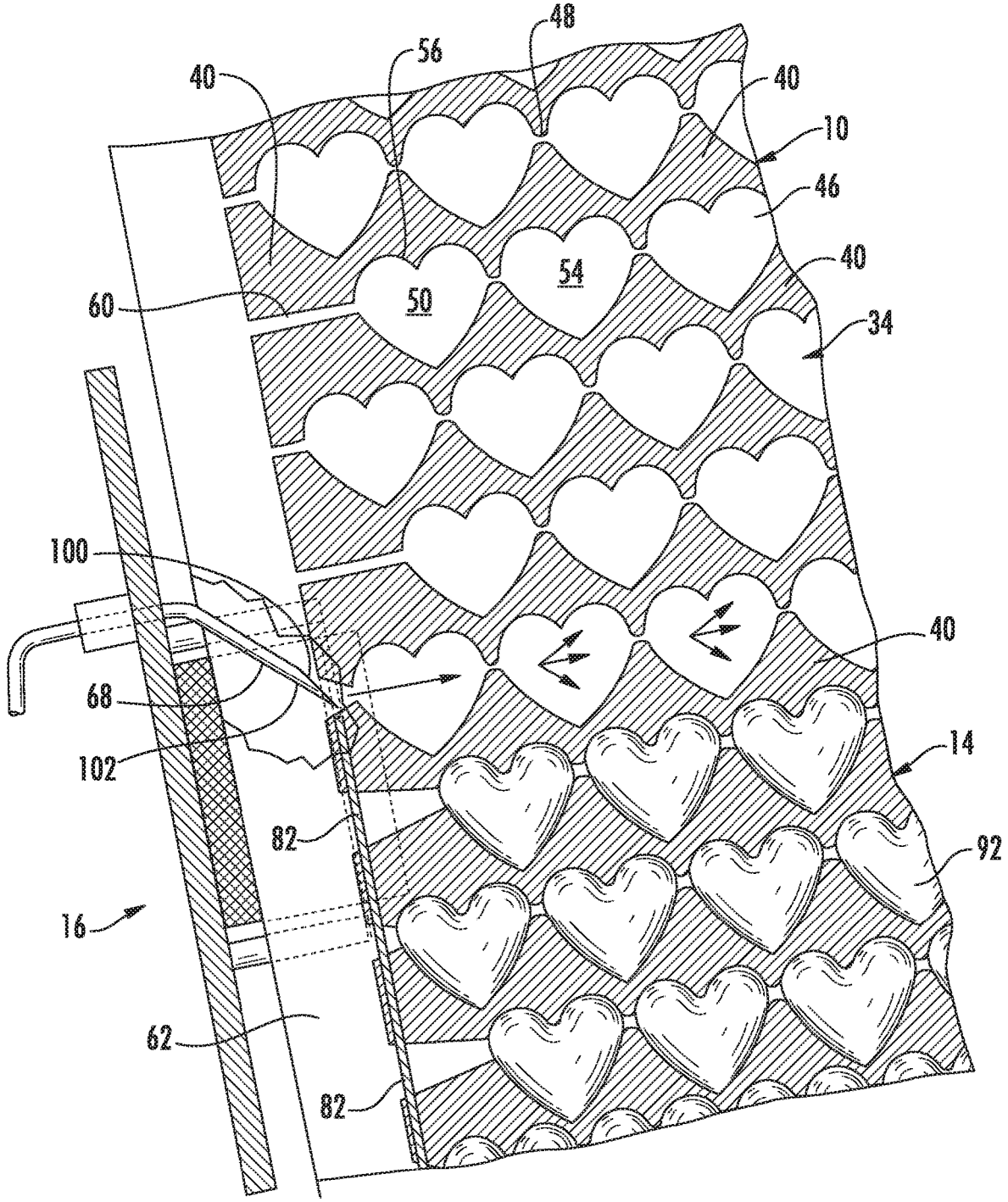
FIG. 5 is a representative sectional view taken along the line 5-5 of FIG. 3.

In operation to sequentially inflate the inflation rows 34 (and inflatable cells 46 therein, inflation nozzle 68 of machine 16 is within the travel path of web 10 and is positioned for placement between the top and bottom longitudinal flanges 62, 64 of web 10. (FIGS. 2 to 5.) FIG. 5 illustrates a portion of top film 30 broken away for clarity. As used herein with reference to web 10, the term "longitudinal" refers to the direction of conveyance of web 10 through apparatus 16 as indicated in the drawings; "longitudinal" also corresponds to the direction of the length dimension (longest dimension) of web 10.

Inflation nozzle 68 comprises a gas outlet port 100 at distal end 102 for injection of gas (e.g., air) into the inflation rows 34. Inflation nozzle 68 is adapted to position gas outlet port 100 closely adjacent to inflation ports 60 and the proximal edge of sealed region 40. While conveying mechanism 66 conveys web 10 along its travel path, inflation nozzle 68 moves continuously and longitudinally between the top and bottom flanges 62, 64 and sequentially inflates the inflation rows 34 and the inflatable cells 46 therein by introducing gas into their corresponding inflation ports 60.

The positioning of gas outlet port 100 closely adjacent to inflation ports 60 may be achieved by adapting at least a portion of inflation nozzle 68, preferably distal end 102, to move in response to movement of web 10 past the nozzle. Additionally, distal end 102 of the inflation nozzle is preferably biased towards (i.e., urged against) inflation ports 60 and the proximal edge of sealed regions 40, and as a result, is caused to move as web 10 moves past inflation nozzle 68. Such movement of the distal end 102 of the inflation nozzle 68 is essentially oscillatory. At the upper end of the oscillation, the inflation nozzle begins to inflate a chamber. At the lower end of the oscillation, the distal end of the nozzle, which has been pulled downwards towards the nip between cylinders 74 and 76 (where the formation of longitudinal seal 82 begins), the distal end disengages with the now-inflated inflation row and rebounds upwards towards the next, adjacent row to be inflated.

Gas may be introduced by inflation nozzle 68 into the inflation rows 34 at greater than atmospheric pressure ranging, for example, from 1 to 25 psi above atmospheric pressure, such as from 2 to 10 psi.

Inflated Web

Figure 6:
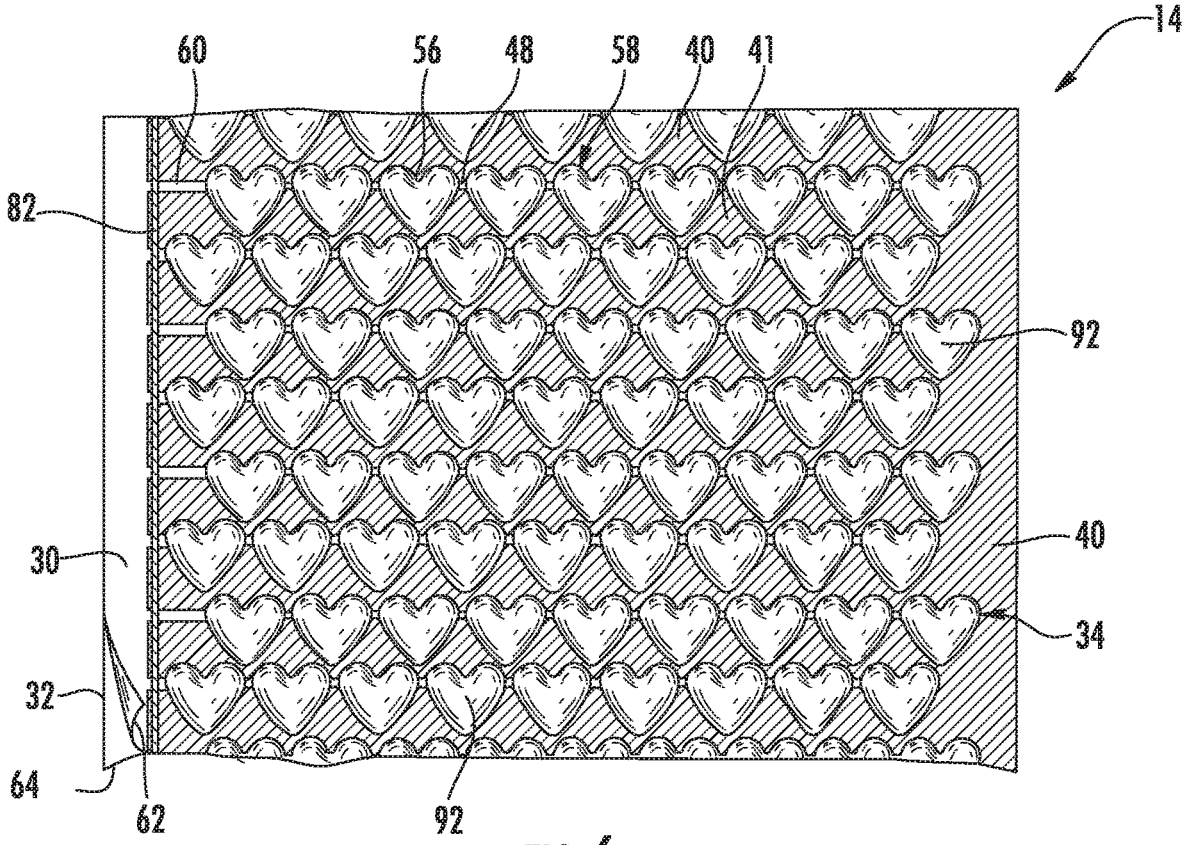
FIG. 6 is a representative top plan view of the inflated web 14, inflated from inflatable web 10 of FIG. 1.
Figure 8:
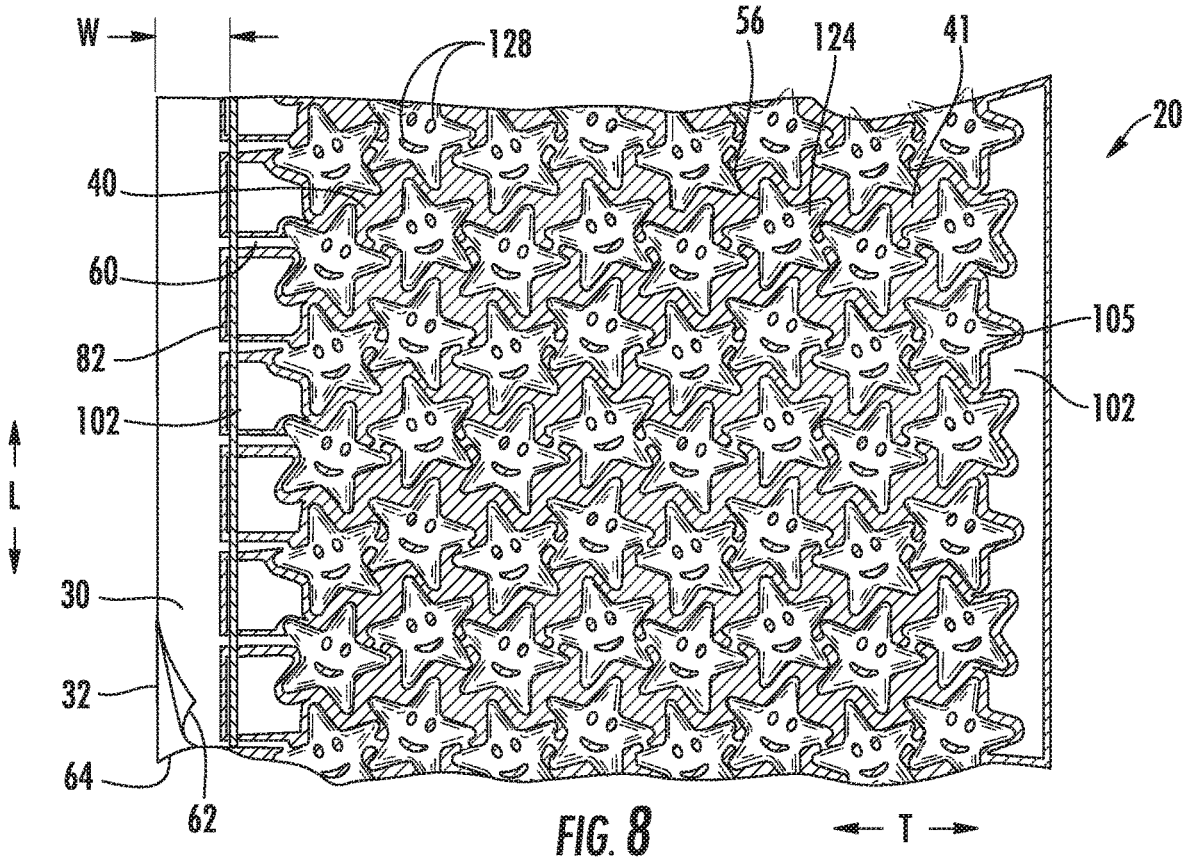
FIG. 8 is a representative top plan view of the inflated web 20, inflated from inflatable web 18 of FIG. 7.
Figure 10:
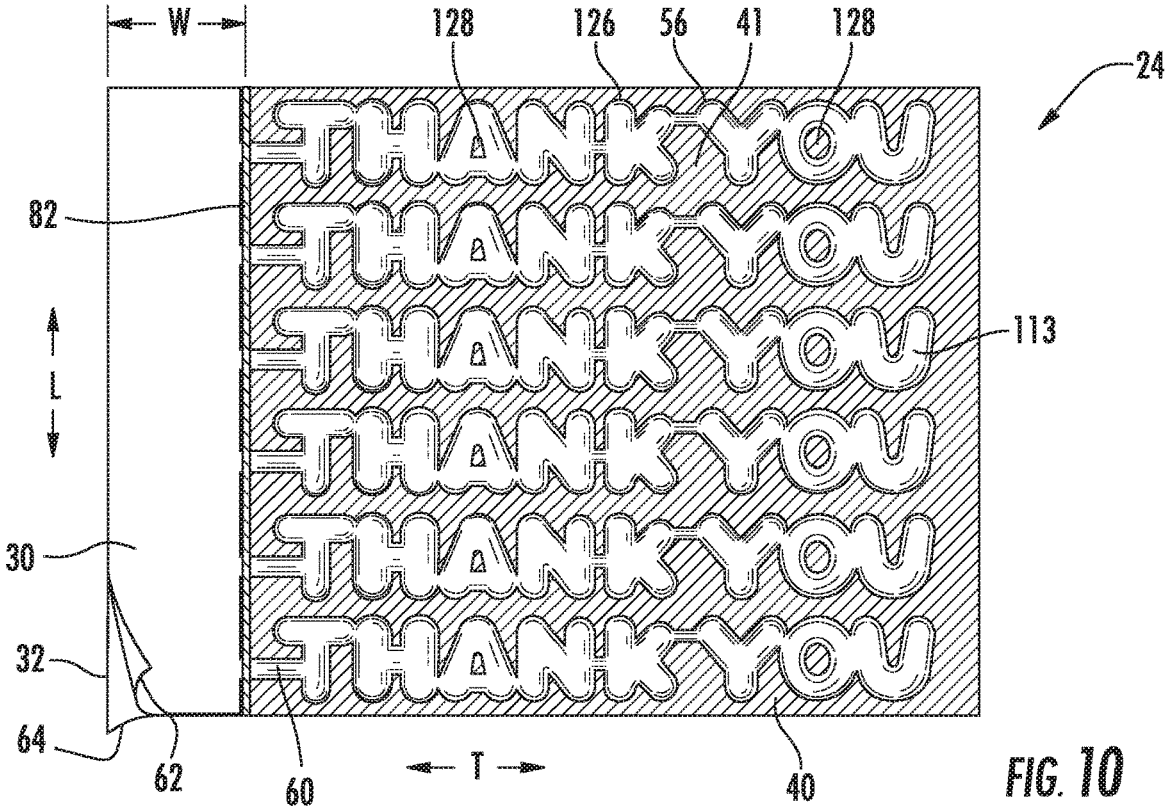
FIG. 10 is a representative top plan view of the inflated web 24, inflated from inflatable web 22 of FIG. 9.

The inflated cushioning webs 14, 20, 24 of FIGS. 6, 8, and 10, respectively, result from the inflation of the inflatable webs 10, 18, and 22 of FIGS. 1, 7, and 9, respectively, and have longitudinal seal 82 closing the inflation ports 60 so that the inflation rows 34, 36. and 38 retain the inflation gas to maintain inflated cells 92, 105, 113, respectively.

Additional Inflatable Web Embodiments

Inflatable web 210 (FIG. 12) and inflated web 274 (FIG. 13) each have top film 30 sealed (i.e., heat sealed) to bottom film 32 (not visible) to define sealed regions 212, in which the top film 30 is heat sealed to the bottom film 32, and non-sealed regions 214, in which the top film 30 is not heat sealed to the bottom film 32.

Similarly, inflatable web 280 (FIG. 19) has white top film 266 sealed (i.e., heat sealed) to a green bottom film (not visible) to define sealed regions 212, in which the top film 266 is heat sealed to the bottom film, and non-sealed regions 214, in which the top film 266 is not heat sealed to the bottom film.

Figure 12:
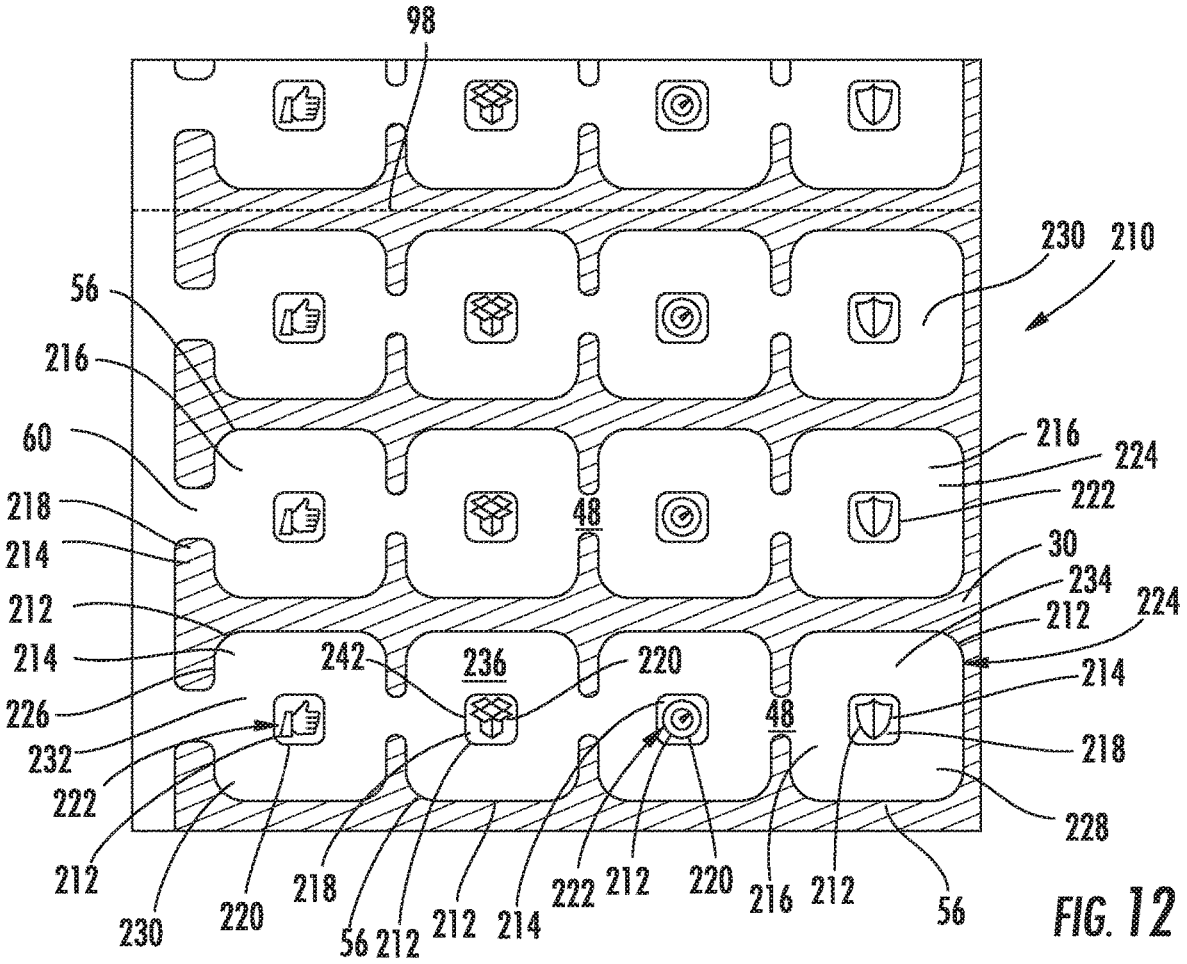
FIG. 12 is a representative top plan view of an alternative inflatable web 210.
Figure 19:
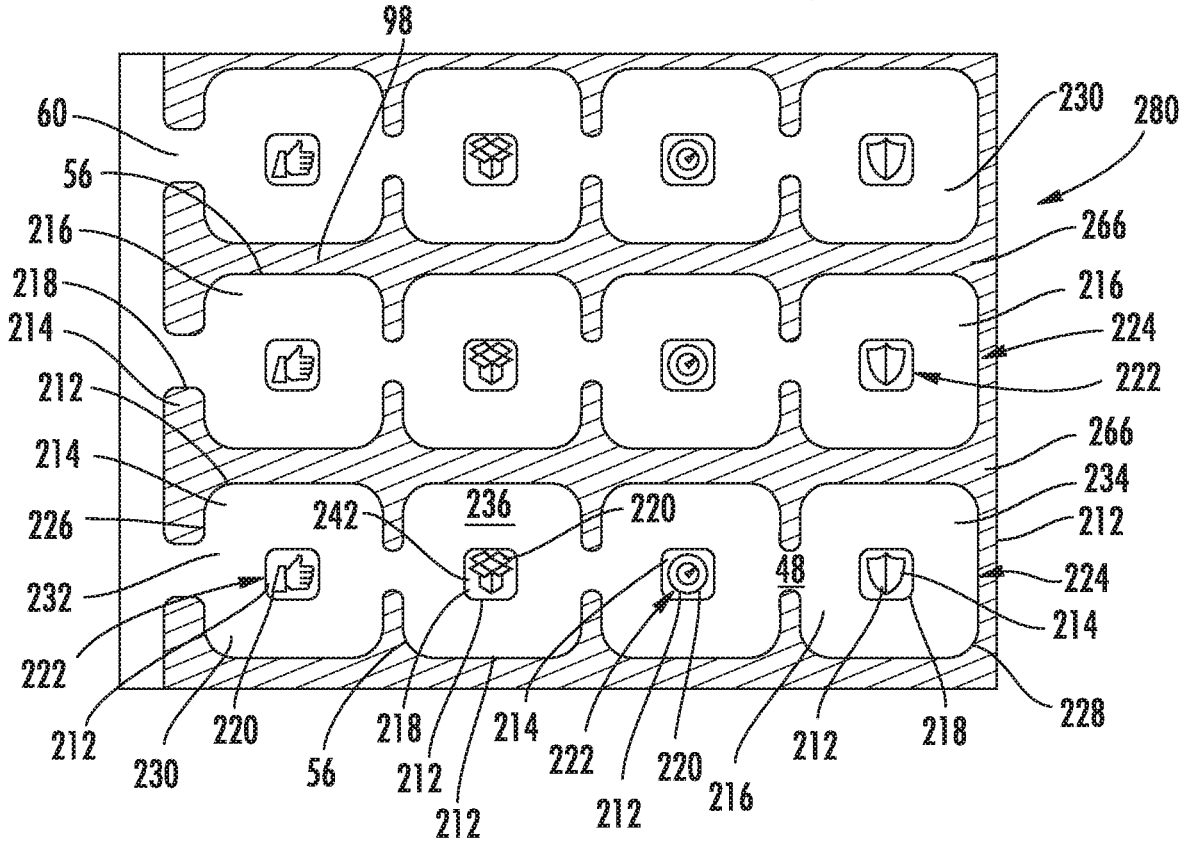
FIG. 19 is a representative top plan view of an alternative inflatable web 280.

The non-sealed regions 214 include inflatable regions 216 of the non-sealed regions 214, the inflatable regions 216 being inflatable through one or more inflation ports 60, for example, as described herein. (FIGS. 12, 19.) The non-sealed regions 214 also include non-inflatable regions 218 of the non-sealed regions 214, the non-sealed regions 214 not being inflatable through the one or more inflation ports 60.

Figure 13:
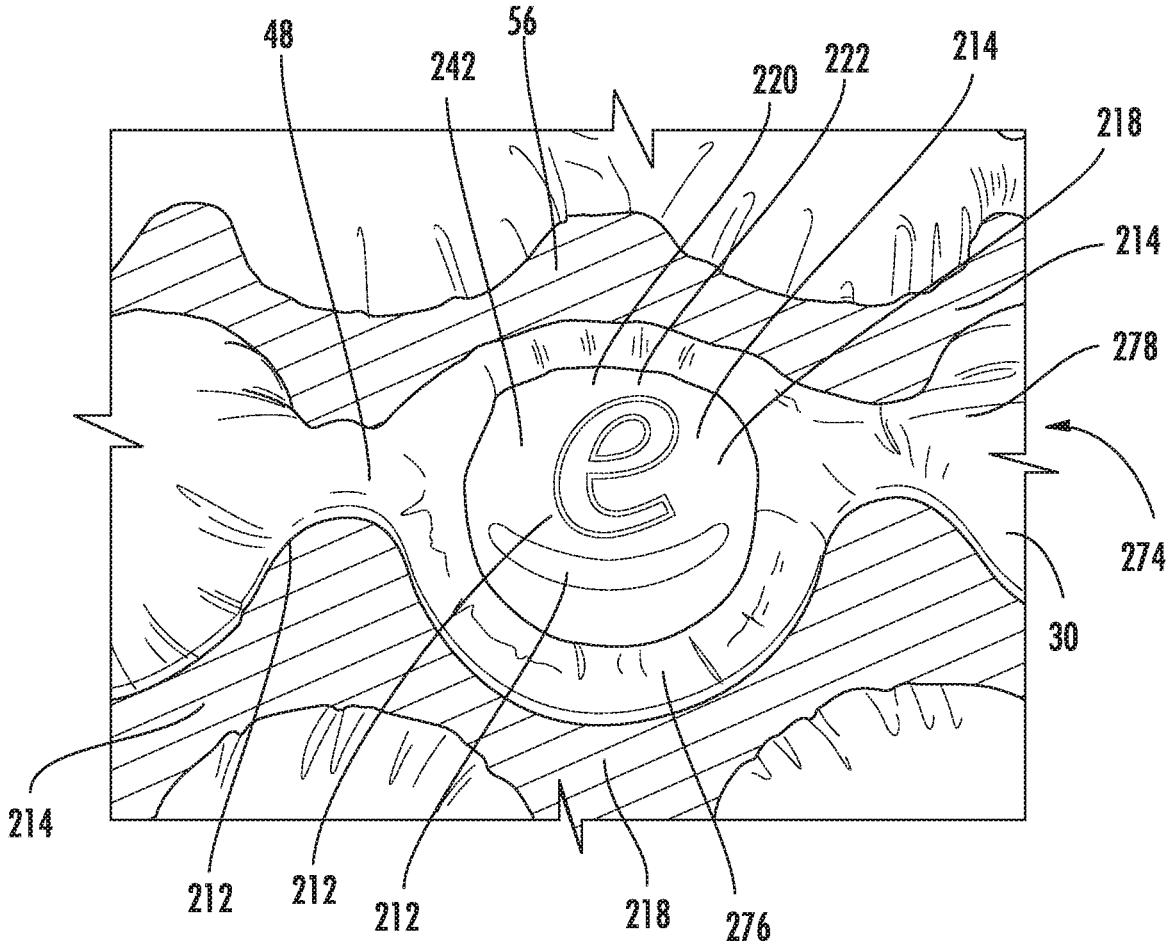
FIG. 13 is a representative top plan detail view of an alternative inflated web 274.

The sealed regions 212 include graphic image portions 220, which define one or more graphical images 222 formed by the visual contrast between the graphic image portions 220 of the sealed regions 212 and the adjacent non-inflatable regions 216 of the non-sealed regions 214. As used herein, "graphical image" includes one or more of a symbol, text, alphanumeric characters, a logo, an icon, an emoticon, an ideogram, a pictogram, a pictograph, a geometric design, a picture, and the like. (FIGS. 12, 13, 19.)

Sealed regions 212 and inflatable regions 216 (of the non-sealed regions 214) define a plurality of inflation rows 224. (FIGS. 12, 19.) Each inflation row 224 has a proximal end 226 and a distal end 228 opposite the proximal end. Each inflation row 224 includes a plurality of inflatable cells 230. The inflatable cells 230 of an inflation row 224 are in fluid communication with each other via interconnecting inflation channels 48 between adjacent inflatable cells 230. Each plurality of inflatable cells 230 of an inflation row 224 includes a proximal inflatable cell 232 at the proximal end 226 of the inflation row 224, a distal inflatable cell 234 at the distal end 228 of the inflation row 224, and one or more (e.g., a plurality) of intermediate inflatable cells 236 between the proximal inflatable cell 232 and the distal inflatable cell 234. (FIGS. 12, 19.)

The one or more inflation ports 60 are at the proximal end 226 of each inflation row 224 to inflate the inflatable regions 216 of the inflation rows 224. (FIGS. 12, 19.) The inflation ports and their use are described herein.

The sealed regions 212 define each inflatable cell 230 by a peripheral seal boundary 56 defining the corresponding peripheral shape of the inflatable cell 230. The peripheral seal boundary 56 of each of the inflatable cells 230 accommodates the interconnecting inflation channels 48, as described herein. (FIGS. 12, 13, 19.)

Figure 11:
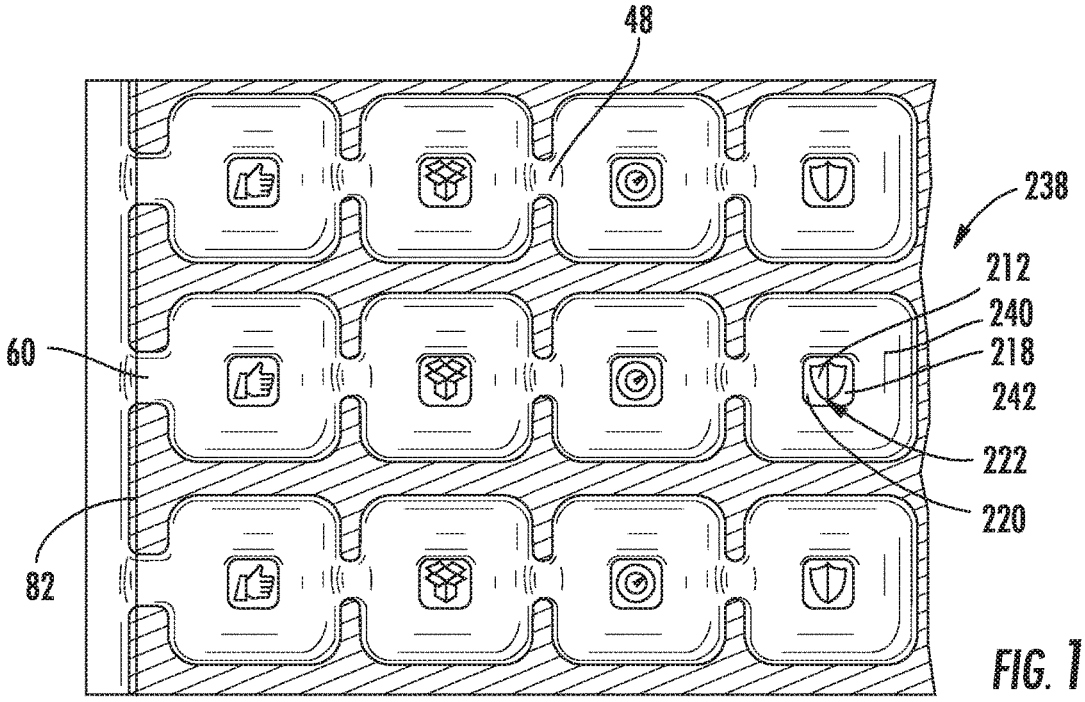
FIG. 11 is a representative top plan view of the inflated web 238, inflated from inflatable web 210 of FIG. 12.
Figure 18:
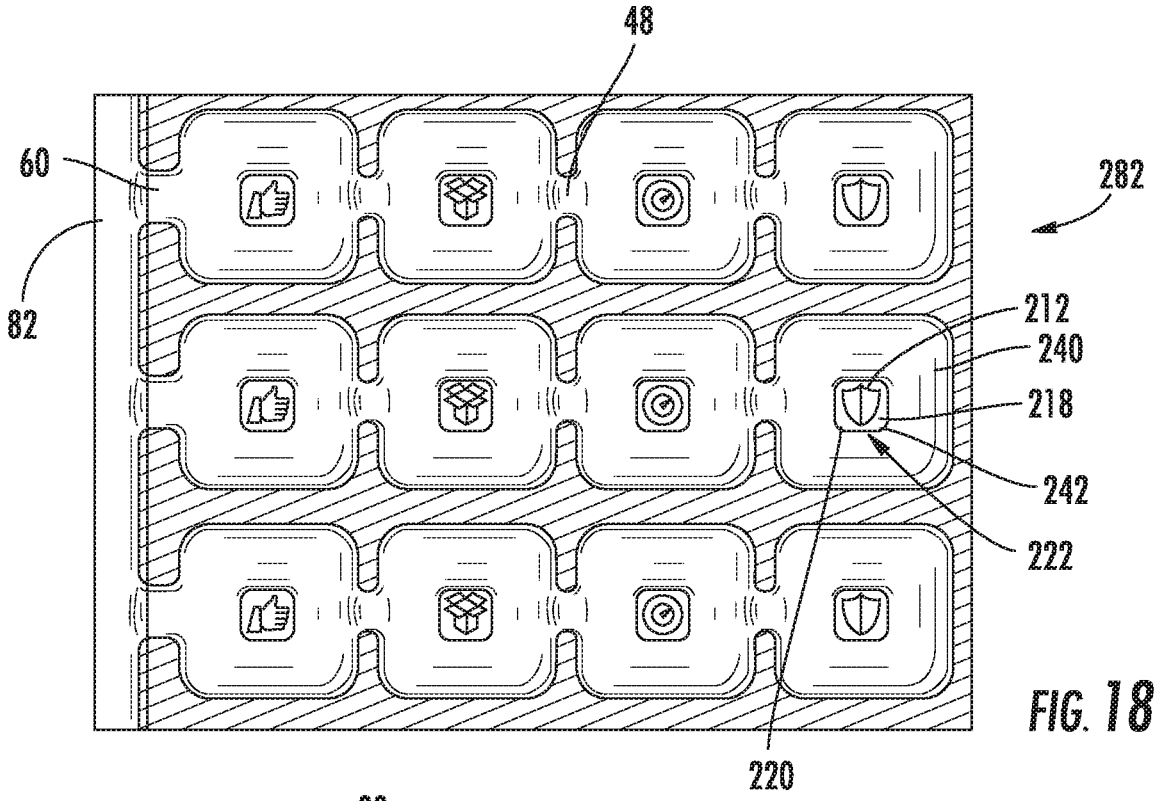
FIG. 18 is a representative top plan view of an alternative inflated web 282, inflated from inflatable web 280 of FIG. 19.

In the embodiments of FIGS. 12, 19, the peripheral seal boundary 56 of one or more of the inflatable cells 230 circumscribes (i.e., surrounds with a perimeter including the interconnecting inflation channel portions) both a portion 242 of the non-inflatable regions 218 and one or more graphic image portions 220 of the sealed regions 212. (FIGS. 12, 19.) When inflated as shown in FIGS. 11, 18, the inflated cell 240 of inflated web 238 surrounds the portion 242 of the non-inflatable regions 218 and the one or more graphic image portions 220 of the sealed regions 212 therein, to "frame" the graphic image 222 and provide a visual border to the graphic image 222.

FIG. 13 illustrates inflated web 274 having non-sealed regions 214 and sealed regions 212. Inflation row 278 includes inflated cell 276 having peripheral seal boundary 56 accommodating interconnecting inflation channels 48, as described above. The peripheral seal boundary 56 of the inflated cell 276 circumscribes (i.e., surrounds with a perimeter including the interconnecting inflation channel portions) both a portion 242 of the non-inflatable regions 218 and one or more graphic image portions 220 of the sealed regions 212. (FIG. 13.) The inflated cell 276 of inflated web 274 surrounds the portion 242 of the non-inflatable regions 218 and the one or more graphic image portions 220 of the sealed regions 212 therein, to "frame" the graphic image 222 (in this case the underlined letter "a") and provide a visual border to the graphic image 222.

Figure 20:
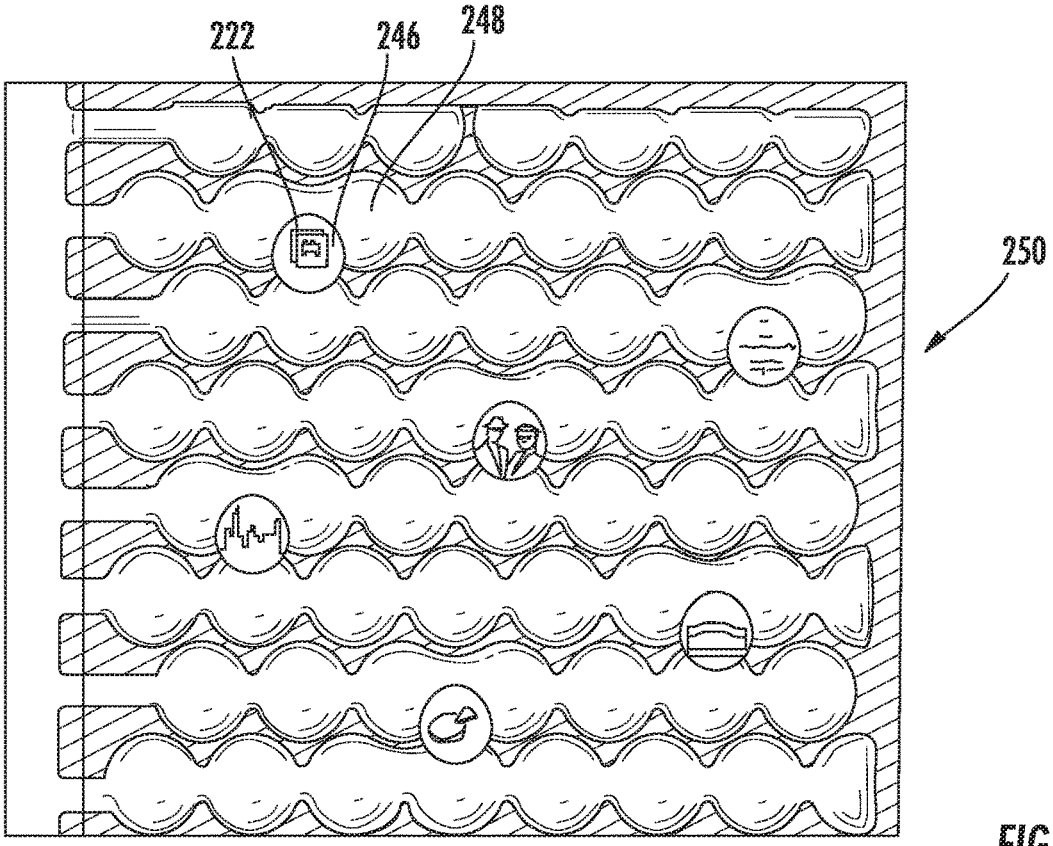
FIG. 20 is a representative top plan view of an alternative inflated web 250, inflated from inflatable web 284 of FIG. 21.
Figure 21:
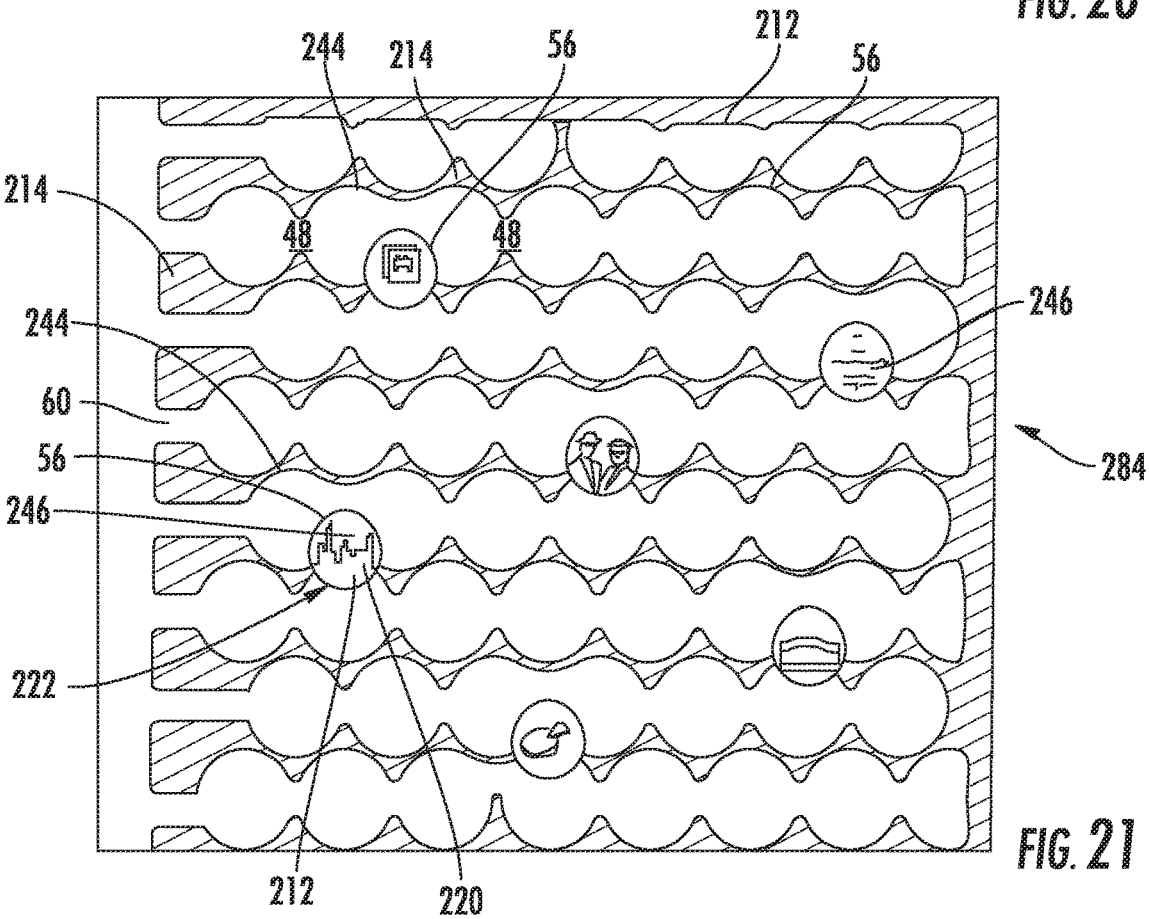
FIG. 21 is a representative top plan view of an alternative inflatable web 284.

In the inflatable web 284 embodiment of FIG. 21, the peripheral seal boundary 56 of one or more of the inflatable cells 244 defines a corresponding concave non-inflatable region 246 located outside of and delineated by the peripheral seal boundary 56 of the inflatable cell 244. One or more graphic image portions 220 of the sealed regions 212 defining graphical images 222 formed by the visual contrast between the graphic image portions 220 of the sealed regions 212 and the adjacent concave non-inflatable region 246. When inflated as inflated web 250 as shown in FIG. 20, the inflated cell 248 corresponding to the concave non-inflatable region 246 of the inflated web 250 partially "frames" the graphic image 222 and provide a partial visual border to the graphic image 222.

Color and Appearance Attributes of Top and Bottom Films

The top film of any of the embodiments disclosed herein may be either (i) colorless by not comprising colorant or (ii) may comprise a top film mixture of thermoplastic polymer and one or more top film colorants dispersed therein to provide a top film color. The bottom film of any of the embodiments disclosed herein may be either (ii) colorless by not comprising colorant or (ii) may comprise a bottom film mixture of thermoplastic polymer and one or more bottom film colorants dispersed therein to provide a bottom film color.

For any embodiment disclosed herein, the bottom film may comprise a bottom film mixture of thermoplastic polymer and one or more bottom film colorants dispersed therein to provide a bottom film color, while the top film may be either (i) colorless by not comprising colorant or (ii) may comprise a top film mixture of thermoplastic polymer and one or more top film colorants dispersed therein to provide a top film color. In such case, the bottom film color may differ from the top film color or top film lack of color to create a visual contrast between the sealed regions 212 and the adjacent non-sealed regions 214 when the web is viewed from the top film side.

Colorants (i.e., pigments or dyes) may be mixed with (i.e., dispersed in) thermoplastic polymer to impart a desired color (e.g., black, gray, white, green, red, blue, purple, orange, yellow, etc.) to the resulting mixture and the film made therefrom.

For any of the inflatable web embodiments disclosed herein, the CIELAB total color difference (ΔE*) between the top film and the bottom film may be at least any one of 20, 30, 40, 50, 60, 70, 80, 90, and 100. Also, or alternatively, the CIELAB total color difference (ΔE*) between the top film and the bottom film may be at most any one of 120, 100, 90, 80, 70, and 50. The CIELAB total color difference (ΔE*) between the top and bottom films may be calculated by using the CIE 1976 L* a* b* opponent-color scales and tristimulus values according to ASTM D2244.

$$\Delta E_{ab}^{*}=\sqrt{(\Delta L^{*})^{2}+(\Delta a^{*})^{2}+(\Delta b^{*})^{2}}$$

Instrument measurements based on tristimulus values may be obtained with a colorimeter or spectrophotometer (e.g., HunterLab ColorFlex EZ spectrophotometer) used according to ASTM D6290.

The total luminous transmittance (i.e., total transmittance) for either of the top and bottom films may independently be at least, and/or at most, any one of the following values: 10%, 20%, 30%, 40%, 50%, 60%, 65%, 70%, 75%, 80%, 85%, and 90%, measured in accordance with ASTM D1003. For any of the embodiments disclosed herein, the difference between the total transmittance of the top film and the total transmittance of the bottom film (in absolute value) may be at least at least any one of 5, 10, 15, 20, 30, 40, 50, 60, and 70 percentage points, and/or at most any one of 70, 60, 50, 40, 30, 20, and 10 percentage points. One method of characterizing opacity is to use the formula 100−total transmittance=opacity.

Contrast Ratio Opacity measurement also characterizes how opaque a film sample is using two readings. The measurement is a two part program metric where the CIE Y (luminance or brightness) value is first measured with the film sample backed by a black background, followed by a second measurement of the Y value of the sample backed by a white background. The resulting fraction is expressed as Y %, calculated as follows:

$$\text{Opacity}(Y)=\frac{Y_{black\ \ backing}}{Y_{white\ backing}}\times 100$$

The contrast ratio opacity for either of the top and bottom films may independently be at least, and/or at most, any one of the following values: 10%, 20%, 30%, 40%, 50%, 60%, 65%, 70%, 75%, 80%, 85%, and 90%, calculated per above with base values measured in accordance with ASTM D1746. The difference between the contrast ratio opacity of the top film and the contrast ratio opacity of the bottom film (in absolute value) may be at least any one of 5, 10, 15, 20, 30, 40, 50, 60, and 70 percentage points. The difference between the contrast ratio opacity of the top film and the contrast ratio opacity of the bottom film (in absolute value) may be at most any one of 70, 60, 50, 40, 30, 20, and 10 percentage points.

Figure 14:
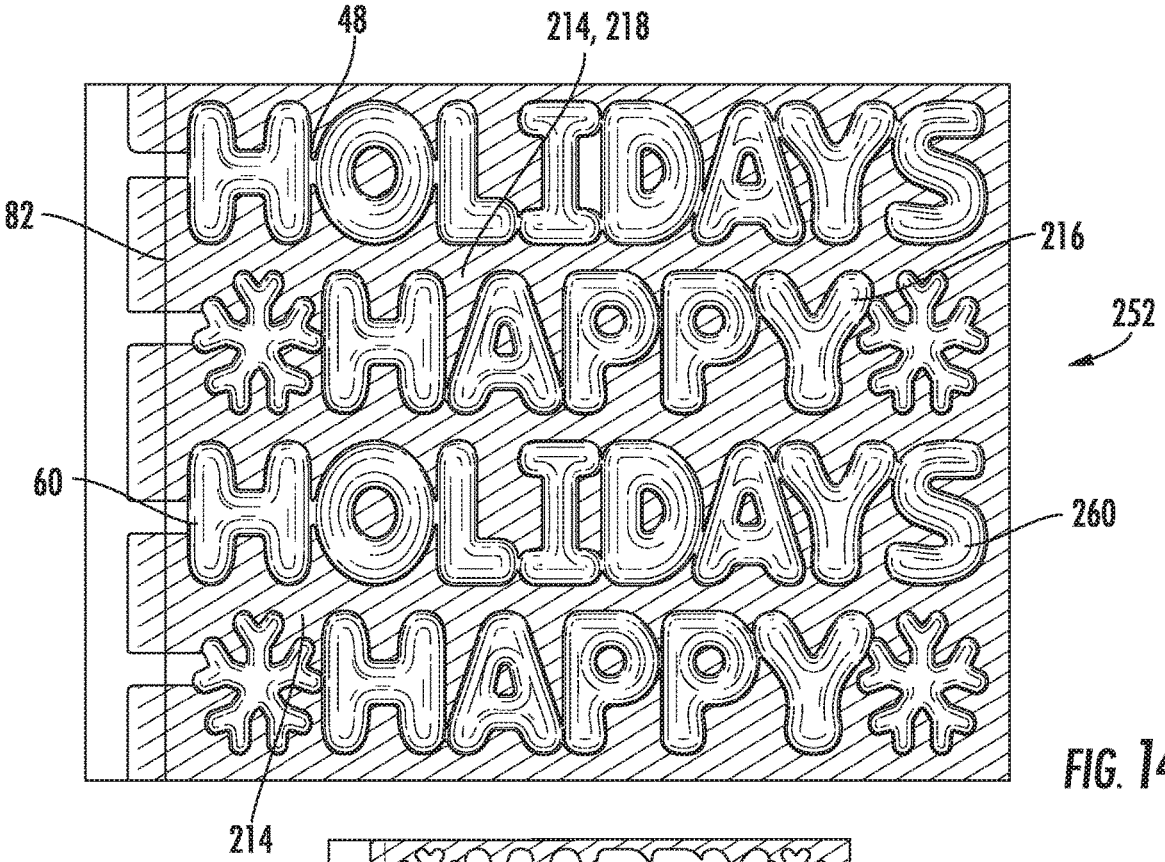
FIG. 14 is a representative top plan view of the inflated web 252, inflated from inflatable web 268 of FIG. 15.
Figure 15:
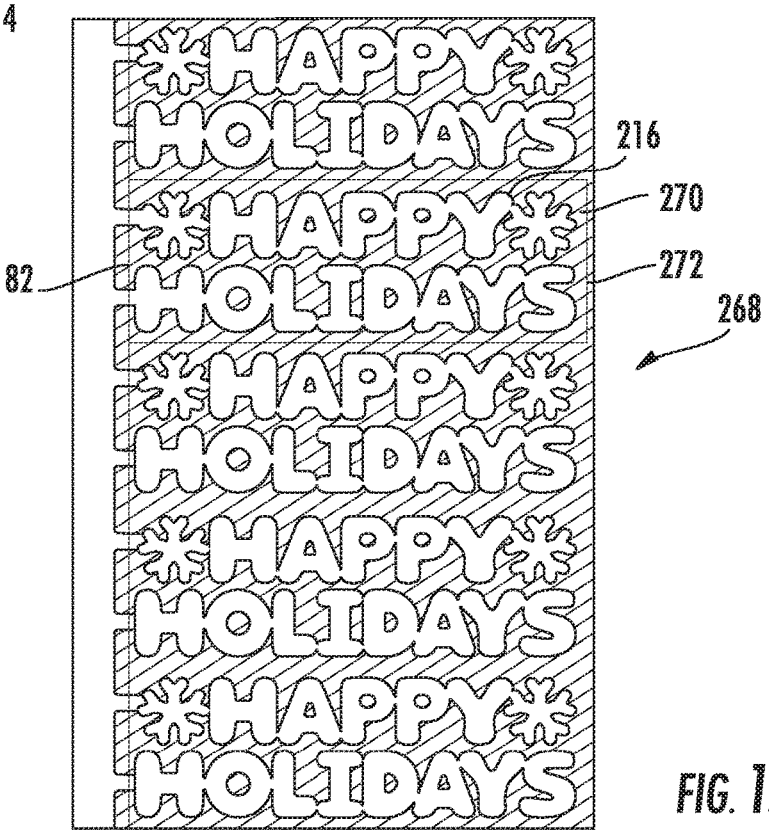
FIG. 15 is a representative top plan view of an alternative inflatable web 268.
Figure 16:
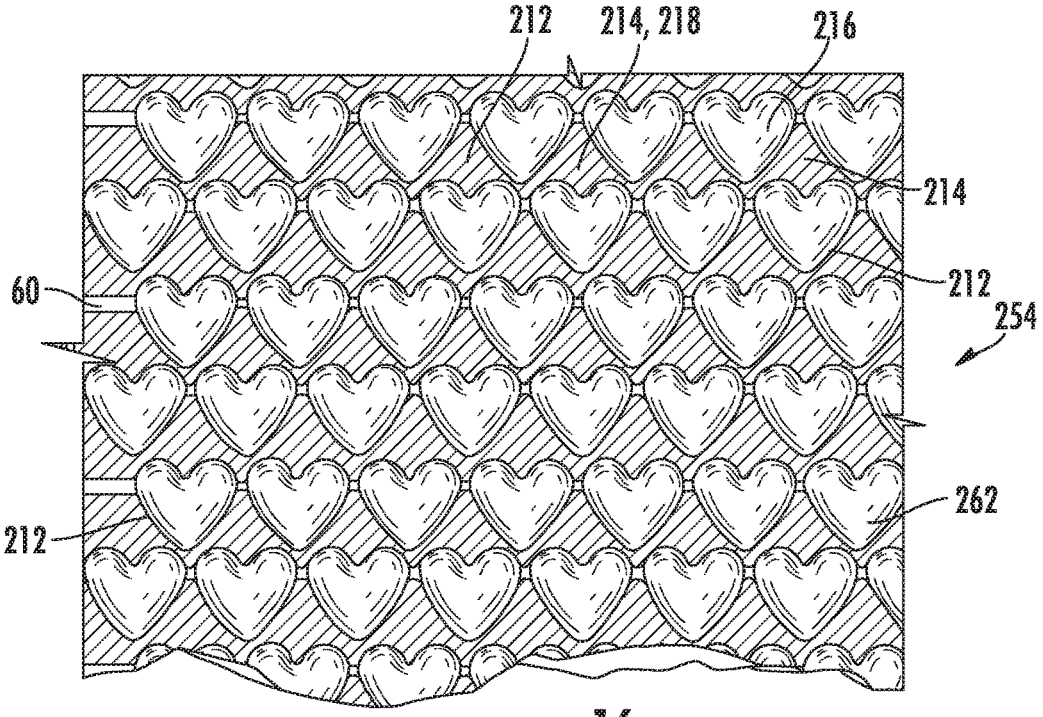
FIG. 16 is a representative top plan view of an alternative inflated web 254.
Figure 17:
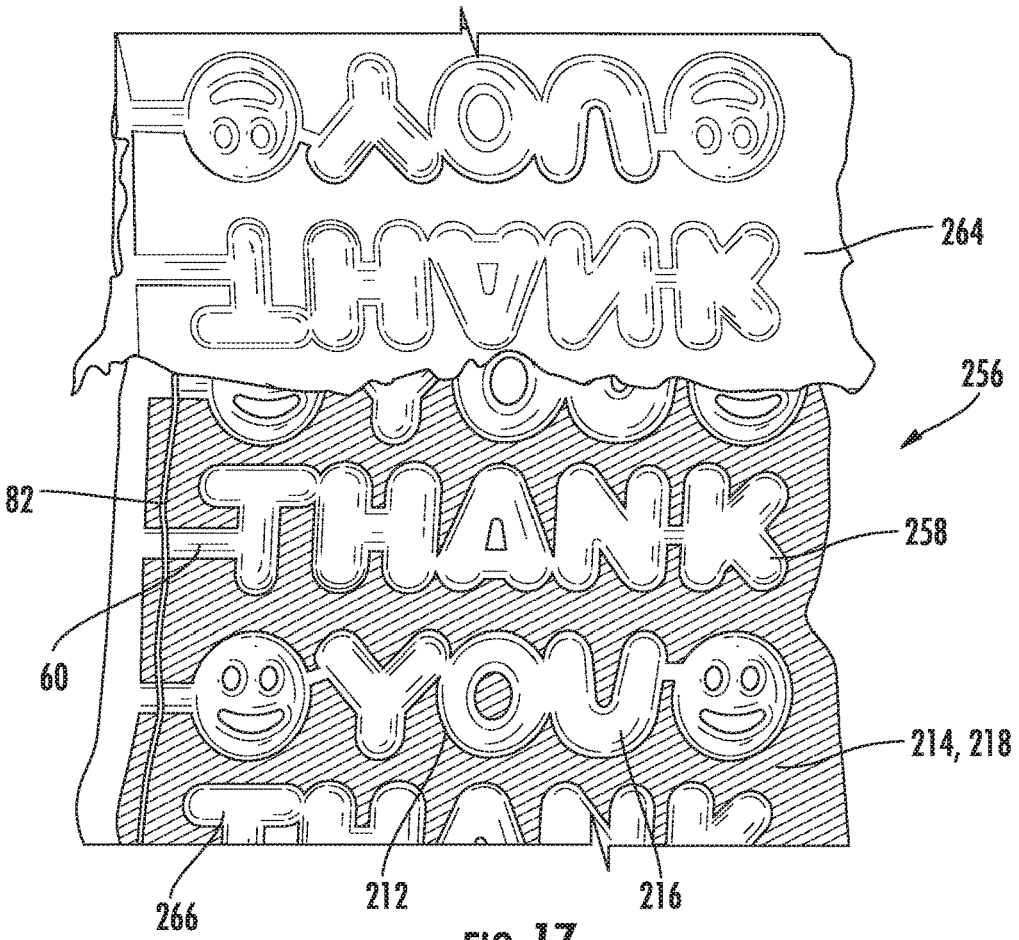
FIG. 17 is a representative top plan view of an alternative inflated web 256.

FIGS. 15, 16, and 17 show inflated webs 252, 254, and 256, respectively. The inflatable webs that were inflated to create the inflated webs 252, 256 of FIGS. 14 and 17 are similar in many respects to that of the FIG. 9-10 embodiment described herein, except for the peripheral shapes of some of the inflated cells. For example, the inflated cells 113 of the FIG. 9-10 embodiment spell out "thank you" whereas the inflated cells 260 of FIG. 14 spell out "happy holidays" and include a snowflake pictograph; and the inflated cells 258 of FIG. 17 spell out "thank you" and include a smiley face pictograph. Also, there are non-sealed, non-inflatable regions 214, 218 between the inflated cells 260 of the FIG. 14 inflated web 252 and between the inflated cells 258 of FIG. 17 inflated web 256; whereas there are sealed regions 40 between the inflated cells 92 of FIGS. 1, 6 such that there are no non-sealed regions.

Likewise, the inflatable web that was inflated to create the inflated web 254 of FIG. 16 is similar in many respects to that of the FIGS. 1 and 6 embodiment described herein, except that there are non-sealed, non-inflatable regions 214, 218 between the inflated cells 262 of the FIG. 16 inflated web 254; whereas there are sealed regions 40 between the inflated cells 92 of FIGS. 1, 6.

The other difference is that the embodiments of FIGS. 14 to 17 have a bottom film color that differs from the top film color to create a visual contrast between the sealed regions 212 and the adjacent non-sealed regions 216, 218 when viewed form the top film side; whereas the embodiments of FIGS. 1, 6, 9, and 10 used the same film appearance characteristic for the top and bottom films.

The inflatable web used to make the inflated web 252 of FIG. 14 used a green film as the bottom film and a white film as the top film. The inflatable webs used to make the inflated webs 254 and 256 of FIG. 16, 17, respectively, used a red film as the bottom film and a white film as the top film.

The physical and optical characteristics of the green, red, and white films are set forth in Table 1.

TABLE 1

| Film | Thickness (mils) | L* | a* | b* | Total Transmittance (%) | Contrast Ratio Opacity (%) |
|---|---|---|---|---|---|---|
| White | 1.36 | 93.47 | −1.16 | −0.72 | 67.8 | 48.7 |
| Green | 1.31 | 70.22 | −27.32 | −6.12 | 58.0 | 36.4 |
| Red | 1.25 | 51.56 | 65.81 | 18.23 | 34.0 | 29.1 |

The inflated webs 254 and 256 of FIGS. 16 and 17, respectively used the white film as the top film and the red film as the bottom film. The inflated webs 252, 282, and 256 of FIGS. 14, 18, and 20, respectively, used the white film as the top film and the green film as the bottom film. The total color difference and other optical differences between the top/bottom film combinations used are set forth in Table 2.

TABLE 2

| Top/Bottom Film | ΔE* | Δ Total Transmittance (percentage points) | Δ Contrast Ratio Opacity (percentage points) |
|---|---|---|---|
| White/Green | 35.64 | 9.8 | 12.3 |
| White/Red | 81.13 | 33.8 | 19.6 |

The use of a bottom film having a bottom film color that differed from the top film color (or a top film lack of color) provided a surprising and unexpected "pop" or "wow" of visual distinctiveness and contrast for the inflated cells therein when viewed from the top film side. As such, the inflated cells were much easier to see, notice, and discern.

FIG. 17 shows the inflated web 256 folded over to show the bottom film 264, which is the red film described herein, and the top film 266, which is the white film described herein in the same view. The visual contrast between the sealed regions 212 and the non-sealed regions 214 (e.g., inflatable regions 216 and non-inflatable regions 218) were unexpectedly and surprisingly visually striking when viewed from the top film 266 side. In comparison, the visual contrast when viewed from the bottom film 264 side was far less dramatic.

Inflatable Surface Area

For any of the embodiments disclosed herein, the ratio of the surface area of the inflatable regions 216 to the total surface area of the inflatable web may be at least any one of 50, 60, 70, and 80%, and/or at most any one of 95, 90, 85, 80, and 75%. For example, the ratio of the inflatable regions 216 to the total surface area for web 252 of FIG. 14 is 57%, for web 254 of FIG. 16 is 67%, for web 282 of FIG. 18 is 68%, and for web 250 of FIG. 20 is 71%.

If the ratio of the surface area of the inflatable regions 216 to the total surface area of the inflatable web is below 50%, then the protective cushioning performance of the inflated web may not be sufficient for desired packaging applications. If the ratio of the surface area of the inflatable regions 216 to the total surface area of the inflatable web is above 95%, then the conformability of the web to fit around protected articles and into containers may be insufficient for protective packaging use; and the web may also lack sufficient non-inflated area to desirably visually distinguish and contrast the inflated cells and/or graphic images of the inflated web.

FIG. 15 illustrates inflatable web 268, which is inflated to create the inflated web 252 of FIG. 14. To illustrate the inflatable area ratio calculation, the black portion encapsulated by rectangle 270 represents the surface area of the inflatable regions 216 for purposes of the ratio; and the total area of the rectangle is the total surface area of the inflatable web for purposes of the ratio. Rectangle 270 extends from the distal edge 272 of the web to the line where the longitudinal seal 82 will be formed after inflation of the web, as described herein. The other boundaries of the rectangle are selected so that the rectangle encompasses a representative pattern of the inflatable regions 216. The ratio of the surface area of the inflatable regions 216 to the total surface area of the inflatable web is calculated by dividing the black area by the rectangular area.

Other ratios may be similarly calculated. For any of the embodiments described herein, the ratio of the surface area of the sealed regions 212 to the total surface area of the web may be at least any one of 10, 15, 20, and 25%; and/or at most any one of 50, 45, 40, 35, 30, and 25%. The ratio of the surface area of the non-inflatable regions 218 to the total surface area of the web may be at least any one of 10, 15, 20, 25, 30, 35, 40, and 50%; and/or at most any one of 50, 45, 40, 35, 30, and 25%.

The inflatable webs may be inflated as described herein. The inflated cushioning webs 238, 282 of FIGS. 11, 18, respectively, result from the inflation of the inflatable webs 210, 280 of FIGS. 12, 19, respectively, and have longitudinal seal 82 closing the inflation ports 60 so that the inflation rows 224 retain the inflation gas to maintain inflated cells 240 in the inflated condition.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of various embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. An inflatable web having a longitudinal direction and a transverse direction perpendicular to the longitudinal direction, the web comprising:

(i) a top film heat sealed to a bottom film to define sealed regions and non-sealed regions, wherein:

the sealed regions have the top film heat sealed to the bottom film;

the non-sealed regions have the top film not heat sealed to the bottom film;

the non-sealed regions further comprise:

inflatable regions being inflatable through one or more inflation ports; and non-inflatable regions that are not inflatable through the one or more inflation ports;

the ratio of the surface area of the inflatable regions to the total surface area of the inflatable web is at least 50% and at most 95%;

the sealed regions comprise graphic image portions defining one or more graphical images formed by the visual contrast between the graphic image portions of the sealed regions and the adjacent non-inflatable regions of the non-sealed regions;

the sealed regions and the inflatable regions of the non-sealed regions define a plurality of inflation rows;

each inflation row has a proximal end and a distal end;

each inflation row comprises a plurality of inflatable cells in fluid communication with each other via an interconnecting inflation channel between adjacent cells of the inflation row, each plurality of inflatable cells comprising a proximal inflatable cell at the proximal end of the inflation row, a distal inflatable cell at the distal end of the inflation row, and one or more intermediate inflatable cells between the proximal and distal inflatable cells; and (ii) one of the one or more inflation ports is at the proximal end of each inflation row to inflate the inflatable region of the inflation row;

wherein:

the top film either (i) is colorless by not comprising colorant or (ii) comprises a top film mixture of thermoplastic polymer and one or more top film colorants dispersed therein to provide a top film color;

the bottom film comprises a bottom film mixture of thermoplastic polymer and one or more bottom film colorants dispersed therein to provide a bottom film color; and the bottom film color differs from the top film color or top film lack of color;

wherein the sealed regions define a peripheral seal boundary for each inflatable cell to define a peripheral shape of the inflatable cell;

wherein the peripheral seal boundary of each of the intermediate inflatable cells accommodates two of the interconnecting inflation channels; and wherein the peripheral seal boundary of one or more of the plurality of inflatable cells circumscribes a portion of the non-inflatable regions and one or more graphic image portions of the sealed regions.

2. The inflatable web of claim 1 wherein each inflation row comprises a plurality of intermediate inflatable cells between the proximal and distal inflatable cells of the inflation row.

3. The inflatable web of claim 1 wherein the top film comprises the top film mixture of thermoplastic polymer and one or more top film colorants dispersed therein to provide the top film color.

4. The inflatable web of claim 1 wherein:

the peripheral seal boundary of one or more of the inflatable cells defines a corresponding concave non-inflatable region located outside of and delineated by the peripheral seal boundary of the inflatable cell; and the one or more graphic image portions of the sealed regions defining graphical images are formed by the visual contrast between the graphic image portions of the sealed regions and the adjacent concave non-inflatable region.

5. The inflatable web of claim 1 wherein the plurality of intermediate inflatable cells of two adjacent inflation rows of the plurality of inflation rows have corresponding peripheral seal boundaries that are spaced apart.

6. The inflatable web of claim 1 wherein at least two of the plurality of intermediate inflatable cells of the respective inflation row of the plurality of inflation rows have differing peripheral shapes.

7. The inflatable web of claim 1 wherein the peripheral shape of the plurality of intermediate inflatable cells of at least one of the plurality of inflation rows differs from the peripheral shape of the plurality of intermediate inflatable cells of another of the plurality of inflation rows.

* * * * *